US010221782B2

(12) United States Patent
Akazaki et al.

(10) Patent No.: US 10,221,782 B2
(45) Date of Patent: Mar. 5, 2019

(54) IN-CYLINDER PRESSURE DETECTING APPARATUS

(71) Applicants: HONDA MOTOR CO., LTD., Tokyo (JP); CITIZEN FINEDEVICE CO., LTD., Yamanashi (JP); CITIZEN WATCH CO., LTD., Tokyo-shi, Tokyo (JP)

(72) Inventors: Shusuke Akazaki, Wako (JP); Masanori Yomoyama, Yamanashi (JP); Tetsuya Aiba, Yamanashi (JP); Kazuo Takahashi, Yamanashi (JP); Takayuki Hayashi, Yamanashi (JP)

(73) Assignees: HONDA MOTOR CO., LTD., Tokyo (JP); CITIZEN FINEDEVICE CO., LTD., Yamanashi (JP); CITIZEN WATCH CO., LTD., Tokyo (JP)

( * ) Notice: Subject to any disclaimer, the term of this patent is extended or adjusted under 35 U.S.C. 154(b) by 137 days.

(21) Appl. No.: 15/021,735

(22) PCT Filed: Mar. 26, 2015

(86) PCT No.: PCT/JP2015/059373

§ 371 (c)(1),
(2) Date: Mar. 14, 2016

(87) PCT Pub. No.: WO2015/151994

PCT Pub. Date: Oct. 8, 2015

(65) Prior Publication Data

US 2016/0222892 A1 Aug. 4, 2016

(30) Foreign Application Priority Data

Apr. 4, 2014 (JP) ..... 2014-077998
Apr. 21, 2014 (JP) ..... 2014-087132
Oct. 29, 2014 (JP) ..... 2014-219805

(51) Int. Cl.
*F02D 35/02* (2006.01)
*F02D 41/28* (2006.01)
(Continued)

(52) U.S. Cl.
CPC ..... *F02D 35/023* (2013.01); *F02D 41/28* (2013.01); *F02M 51/0671* (2013.01);
(Continued)

(58) Field of Classification Search
CPC ..... F02D 2200/0602; F02D 2200/247; F02D 41/26; F02D 41/3005; F02D 2041/389;
(Continued)

(56) References Cited

U.S. PATENT DOCUMENTS 4,562,362 A * 12/1985 Stenbock ..... H03K 3/013 327/205
4,791,809 A * 12/1988 Schmidt ..... F02D 35/0007 123/478
(Continued)

FOREIGN PATENT DOCUMENTS

CN 101490406 A 7/2009
CN 101821494 A 9/2010
(Continued)

OTHER PUBLICATIONS

International Search Report dated May 26, 2015 corresponding to International Patent Application No. PCT/JP2015/059373 and English translation thereof.
(Continued)

*Primary Examiner* — Marguerite McMahon
*Assistant Examiner* — Tea Holbrook
(74) *Attorney, Agent, or Firm* — Squire Patton Boggs (US) LLP

(57) ABSTRACT

An in-cylinder pressure detecting apparatus for detecting a pressure in a combustion chamber of an internal combustion
(Continued)

engine is provided. The in-cylinder pressure detecting apparatus comprises a pressure detecting element mounted on a tip-portion of a fuel injection device which injects fuel into the combustion chamber, and an amplifying circuit unit having an amplifying circuit which amplifies a signal output from the pressure detecting element and outputs a pressure detection signal. An in-cylinder pressure detecting unit integrated fuel injection device is configured by integrating an in-cylinder pressure detecting unit with the fuel injection device. The in-cylinder pressure detecting unit includes the pressure detecting element, the amplifying circuit unit, and a connecting member connecting the pressure detecting element with the amplifying circuit unit. The in-cylinder pressure detecting unit integrated fuel injection device is mounted on the internal combustion engine.

15 Claims, 13 Drawing Sheets

(51) Int. Cl.
*F02M 57/00* (2006.01)
*F02M 51/06* (2006.01)

(52) U.S. Cl.
CPC ..... *F02M 57/005* (2013.01); *F02D 2041/281* (2013.01); *F02D 2041/283* (2013.01); *F02M 51/061* (2013.01); *F02M 2200/16* (2013.01); *F02M 2200/8046* (2013.01)

(58) Field of Classification Search
CPC .... F02M 2200/24; F02M 55/02; F02M 57/05; F02M 61/10; F02M 61/14; F02B 77/085
USPC ..... 123/445, 472, 478, 435; 239/533.2; 277/591; 73/114.18
See application file for complete search history.

(56) References Cited

U.S. PATENT DOCUMENTS 5,339,063 A * 8/1994 Pham ..... F02M 57/02 239/585.1
5,816,220 A * 10/1998 Stumpp ..... F02D 35/025 123/198 DB
6,299,469 B1 * 10/2001 Glovatsky ..... F02D 9/02 439/329
9,309,850 B2 * 4/2016 Akazaki ..... F02M 61/14
9,429,122 B2 * 8/2016 Akazaki ..... F02M 51/061
9,689,362 B2 * 6/2017 Sato ..... F02M 61/14
2001/0056323 A1 * 12/2001 Masters ..... B25J 9/16 701/115
2002/0047507 A1 * 4/2002 Okazaki ..... G01L 23/22 313/141
2002/0053342 A1 * 5/2002 Nozaki ..... F02M 51/005 123/470
2004/0040545 A1 * 3/2004 Nasu ..... F02D 41/20 123/490
2006/0169244 A1 * 8/2006 Allen ..... F02D 35/021 123/297
2006/0207564 A1 * 9/2006 Kinose ..... F02D 41/20 123/431
2006/0229798 A1 * 10/2006 Fukuzawa ..... F02D 41/222 701/114
2010/0050991 A1 * 3/2010 Cooke ..... F02M 51/005 123/470
2010/0096480 A1 * 4/2010 Kondo ..... F02M 47/027 239/584
2010/0251999 A1 * 10/2010 Kondo ..... F02M 47/027 123/470
2010/0263629 A1 * 10/2010 Kondo ..... F02M 47/027 123/445
2010/0263633 A1 * 10/2010 Kondo ..... F02M 47/027 123/478
2010/0313850 A1 * 12/2010 Kondo ..... F02M 47/027 123/445
2013/0338906 A1 * 12/2013 Akazaki ..... F02D 41/3005 701/105
2014/0048041 A1 * 2/2014 Akazaki ..... F02D 35/023 123/445
2014/0083388 A1 * 3/2014 Takahashi ..... F02D 35/023 123/193.2
2015/0059699 A1 * 3/2015 Sato ..... F02M 61/14 123/435
2015/0115069 A1 * 4/2015 Akazaki ..... F02M 61/14 239/584
2015/0152823 A1 * 6/2015 Akazaki ..... F02M 51/061 123/445
2015/0152824 A1 * 6/2015 Akazaki ..... F02M 51/061 239/71
2015/0226641 A1 * 8/2015 Takahashi ..... G01L 23/08 73/114.18

FOREIGN PATENT DOCUMENTS

CN 101858287 A 10/2010
CN 103380357 A 10/2013
EP 1961952 * 8/2008 ..... F02M 57/00
JP 03-198514 A 8/1991
JP 5-94718 U 12/1993
JP 06-022424 A 1/1994
JP 2004-360626 A 12/2004
JP 2009-536995 A 10/2009
JP 4407044 B2 2/2010
JP 2011-164029 A 8/2011
WO WO 2007/132199 A1 11/2007
WO WO 2012/115036 A1 8/2012
WO WO 2013/129133 A1 9/2013
WO 2013/183307 A 12/2013

OTHER PUBLICATIONS

Chinese Office Action application No. 201580000516.9 dated Mar. 22, 2017.

* cited by examiner

IN-CYLINDER PRESSURE DETECTING APPARATUS

TECHNICAL FIELD

The present invention relates to an in-cylinder pressure detecting apparatus for detecting an in-cylinder pressure which is a pressure in a combustion chamber of an internal combustion engine, and particularly to the in-cylinder pressure detecting apparatus having a pressure detecting element mounted on a tip-portion of a fuel injection device for injecting fuel into the combustion chamber.

BACKGROUND ART

Patent document 1 (shown below) shows a combustion pressure sensor having a pressure detecting element mounted on an ignition plug, a fuel injection valve, or the like of an internal combustion engine, and an amplifying circuit (charge amplifier) which amplifies changes in the voltage of the pressure detecting element to output a pressure detection signal. In this combustion pressure sensor, the pressure detecting element is fixed on the outside of the combustion chamber with the fuel injection valve by a nut for fixing the fuel injection valve, and the amplifying circuit is provided at the sensor-fixing block at which the pressure detecting element is fixed.

Patent document 2 (shown below) shows an in-cylinder pressure detecting apparatus, in which a pressure detecting element is mounted on a tip-portion of the fuel injection valve for injecting fuel into the combustion chamber, and the in-cylinder pressure is detected using the pressure detecting element.

PRIOR ART DOCUMENT

Patent Document

Patent Document 1: Japanese Patent Publication No. 4407044

Patent Document 2: International Publication No. WO2012/115036

SUMMARY OF THE INVENTION

Problems to be Solved by the Invention

According to the combustion pressure sensor shown in patent document 1, it is necessary to fix the sensor-fixed block being sandwiched by the nut at the same time the fuel injection valve is fixed. Accordingly, there exists a room for improvement in workability when fixing the fuel injection valve.

If the pressure detecting element is disposed at the tip-portion of a part of the fuel injection valve inserted into the combustion chamber, as shown in patent document 2, it is desired to realize a structure in which the pressure detecting element and the amplifier are arranged close to each other, with good workability.

The present invention was made contemplating the above-described points, and an objective of the present invention is to provide an in-cylinder pressure detecting apparatus which detects the in-cylinder pressure with the pressure detecting element mounted on a tip-portion of an fuel injection device (fuel injection valve), and is able to reduce influence of the actuation signal for the fuel injection device as well as to improve workability when being mounted on the internal combustion engine.

Solution to the Problem

To attain the above objective, the present invention provides an in-cylinder pressure detecting apparatus for detecting a pressure in a combustion chamber of an internal combustion engine, the in-cylinder pressure detecting apparatus comprising a pressure detecting element (2) mounted on a tip-portion of a fuel injection device (1) which injects fuel into the combustion chamber; and an amplifying circuit unit (11) having an amplifying circuit which amplifies a signal output from the pressure detecting element and outputs a pressure detection signal. The in-cylinder pressure detecting apparatus is characterized in that an in-cylinder pressure detecting unit integrated fuel injection device (100) is configured by integrating an in-cylinder pressure detecting unit (101) with the fuel injection device (1), the in-cylinder pressure detecting unit (101) including the pressure detecting element (2), the amplifying circuit unit (11), and a connecting member (12) connecting the pressure detecting element (2) with the amplifying circuit unit (11), wherein the in-cylinder pressure detecting unit integrated fuel injection device (100) is mounted on the internal combustion engine.

With this configuration, the in-cylinder pressure detecting unit integrated fuel injection device is configured by integrating the in-cylinder pressure detecting unit including the pressure detecting element, the amplifying circuit unit, and the connecting member, with the fuel injection device, and the in-cylinder pressure detecting unit integrated fuel injection device is mounted on the internal combustion engine. Accordingly, the amplifying circuit unit is disposed near the pressure detecting element, thereby reducing the influence from the actuation signal of the fuel injection device. Further, it is possible to mount the fuel injection device with the in-cylinder pressure detecting unit on the internal combustion engine by working similar to that for mounting the fuel injection device without the in-cylinder pressure detecting unit, thereby enhancing workability.

Preferably, the in-cylinder pressure detecting unit (101) is configured by previously assembling a sensor fixing member (13) having a cylindrical shape, the amplifying circuit unit (11), and the connecting member (12) connecting the pressure detecting element (2) with the amplifying circuit unit (11), the pressure detecting element (2) being fixed on a tip-portion of the sensor fixing member (13), wherein the sensor fixing member (13) is fitted onto the tip-portion (4) of the fuel injection device.

With this configuration, the in-cylinder pressure detecting unit is configured by previously assembling the sensor fixing member, the amplifying circuit unit, and the connecting member, and the sensor fixing member on which the pressure detecting element is fixed, is fitted onto the tip-portion of the fuel injection device, thereby configuring the in-cylinder pressure detecting unit integrated fuel injection device. Accordingly, it is possible to enhance workability when integrating the in-cylinder pressure detecting unit with the fuel injection device.

Preferably, the amplifying circuit unit is disposed in the vicinity of a connector (51) to which actuation signal wires are connected. The actuation signal wires supplies an actuation signal from a control unit (60) for controlling the fuel injection device (1) to the fuel injection device (1), and the connector (51) is configured so as to include connecting terminals (31-33) for connecting the wires provided between the amplifying circuit unit (11) and the control unit (60).

With this configuration, the connecting terminals for connecting the wires provided between the amplifying circuit unit and the control unit are included in the connector to which the actuation signal wires are connected, which enables performing power source supply to the amplifying circuit unit, transmission of the pressure detection signal, and transmission of the actuation signal for the fuel injection device, via one connector. Accordingly, it is possible to make the assembling work easier and to reduce the size of the fuel injection device with the amplifying circuit unit.

Preferably, the fuel injection device is provided with a main-body connector block (51*a*) having connecting terminals (21-23) to which actuation signal wires are connected, the actuation signal wires supplying an actuation signal from a control unit (60) for controlling the fuel injection device to the fuel injection device. The in-cylinder pressure detecting unit (101) is provided with a sub-connector block (51*b*) having a connecting terminal (31-33) to which a detection signal wire is connected, the detection signal wire supplying the pressure detection signal to the control unit, and the sub-connector block (51*b*) is configured separately from the main-body connector block (51*a*).

With this configuration, the detection signal wire for transmitting the pressure detection signal is disposed away from the actuation signal wire through which a comparatively large current flows, which enables reducing the influence of the actuation signal acting on the in-cylinder pressure detection signal.

Preferably, the amplifying circuit unit (11) is fixed on an outside of a metal casing (3) which contains an actuation circuit (24) of the fuel injection device, in a state where the amplifying circuit unit is covered by molding material (10, 11*a*), or in a state where the amplifying circuit unit is contained in a metal casing.

With this configuration, the amplifying circuit unit is fixed on the outside of the metal casing which contains the actuation circuit of the fuel injection device, in the state where the amplifying circuit unit is covered by molding material, or in the state where the amplifying circuit unit is contained in a metal casing. Accordingly, handling of the amplifying circuit unit integrated with the fuel injection device can be made easier, and effects of waterproof, heat insulation, and electric insulation of the amplifying circuit can surely be obtained.

Preferably, the amplifying circuit unit (11) includes a failure detection circuit (47) for a control unit (60) to diagnose a connecting condition between the amplifying circuit unit (11) and the control unit (60) to which the pressure detection signal is supplied.

With this configuration, the failure detection circuit makes it possible for the control unit to diagnose the connecting condition between the amplifying unit and the control unit to which the pressure detection signal is supplied.

Preferably, the amplifying circuit unit (11) includes a sensitivity adjusting circuit (46) for performing a sensitivity adjustment of the amplifying circuit.

With this configuration, the sensitivity adjustment can be performed in the state where the pressure detecting element and the amplifying circuit are assembled before mounting the in-cylinder pressure detecting unit on the engine. The amplifying circuit integrates and amplifies the output voltage from the pressure detecting element, and the pressure detection signal is thereby obtained. It is confirmed that differences in characteristics of the pressure detecting element and the amplifying circuit make the detecting sensitivity take different values. Accordingly, by performing the gain adjustment of the amplifying circuit in the state where the pressure detecting element and the amplifying circuit are assembled, it is possible to remove the influence of characteristic differences among pressure detecting elements and amplifying circuits, to accurately perform the pressure detection.

Preferably, the amplifying circuit unit includes a noise filter (49) for eliminating noises entering a power source line (53) for supplying the power source, and/or noises superimposed on the pressure detection signal.

With this configuration, it possible to surely prevent noises from entering the pressure detection signal via the power source line or directly.

Preferably, the amplifying circuit unit is configured on a flexible printed wiring board.

With this configuration, the amplifying circuit unit is configured on a flexible printed wiring board, which makes it possible to reduce the size of the amplifying circuit unit, to make it easier to mount the amplifying circuit unit on the fuel injection device.

Preferably, the in-cylinder pressure detecting unit integrated fuel injection device (100) includes a valve body (233) and a seal member (108). The valve body (233) has the tip-portion (241, 4) inserted into an injector hole (219) which is formed in a main-body (203) of the internal combustion engine, the tip-portion (241, 4) facing the combustion chamber (207). The seal member (108) has an annular shape and seals a gap between an outer surface of the valve body and an inner surface of the pressure detecting element. The pressure detecting element (2) is configured in a cylindrical shape, and the tip-portion of the valve body is inserted inside the pressure detecting element, the pressure detecting element being supported on the outer periphery of the valve body. A tip end portion of the pressure detecting element positioned on the combustion chamber side extends further from the tip end of the valve body toward the combustion chamber, and the tip end portion of the pressure detecting element has a locking block (103) on an inner surface thereof, the locking block (103) projecting toward the axis of the valve body. The seal member is disposed at a corner (121) defined by the inner surface of the pressure detecting element and the tip end surface of the valve body, the seal member being sandwiched between the locking block and the valve body.

With this configuration, the gap between the inner surface of the pressure detecting element and the outer surface of the valve body is sealed with the seal member, which makes it unnecessary to seal the gap by welding. Accordingly, it is possible to prevent changes in the detection characteristic of the pressure detecting element due to deformation of the pressure detecting element caused by the welding heat.

MODE FOR CARRYING OUT THE INVENTION

Preferred embodiments of the present invention will now be described with reference to the drawings.

Figure 1A:
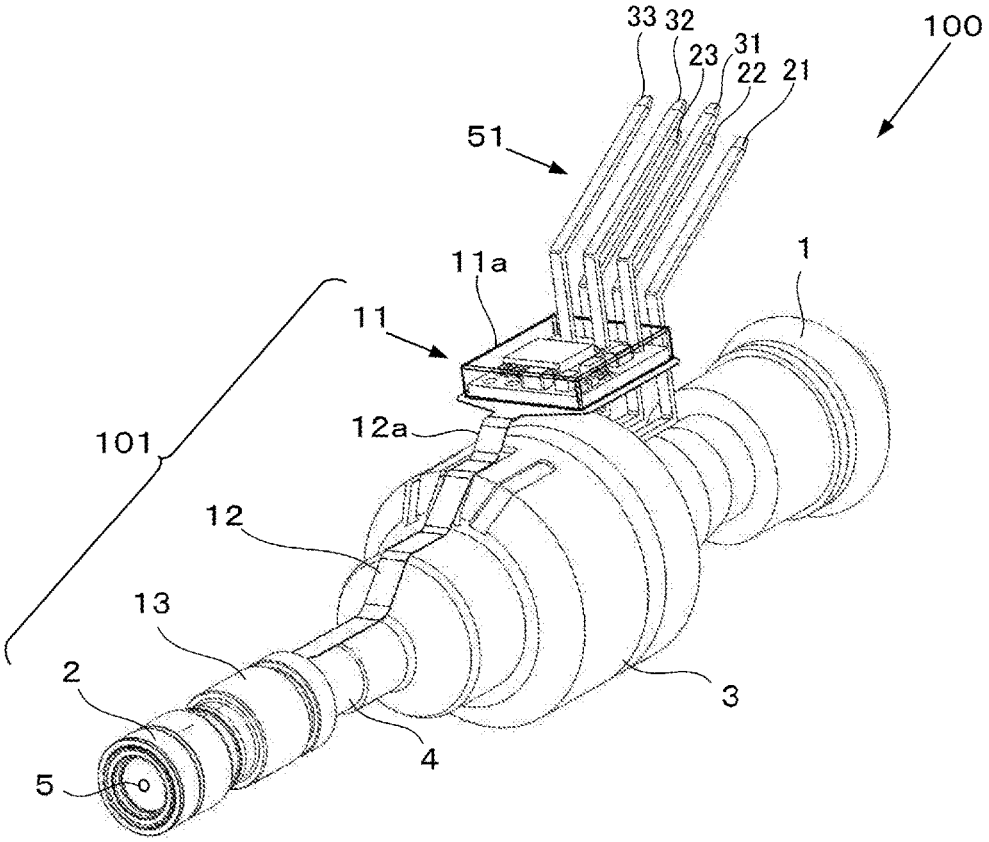
FIGS. 1(*a*) and 1(*b*) show perspective diagrams of an in-cylinder pressure detecting unit integrated fuel injection device according to one embodiment of the present invention.
Figure 1:
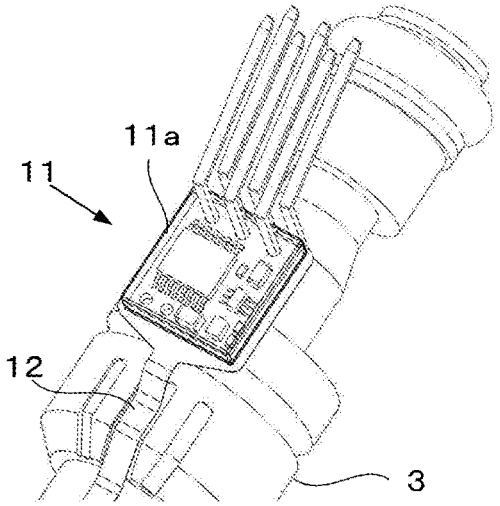
Figure 2:
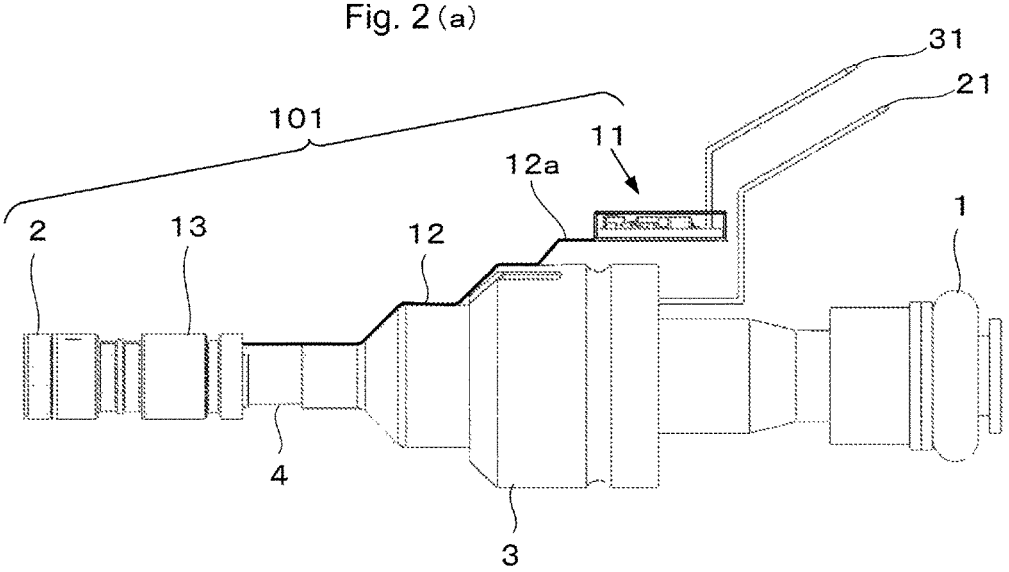
FIGS. 2(*a*)-2(*c*) show side views of the in-cylinder pressure detecting unit integrated fuel injection device shown in FIGS. 1(*a*) and 1(*b*).
Figure 2:
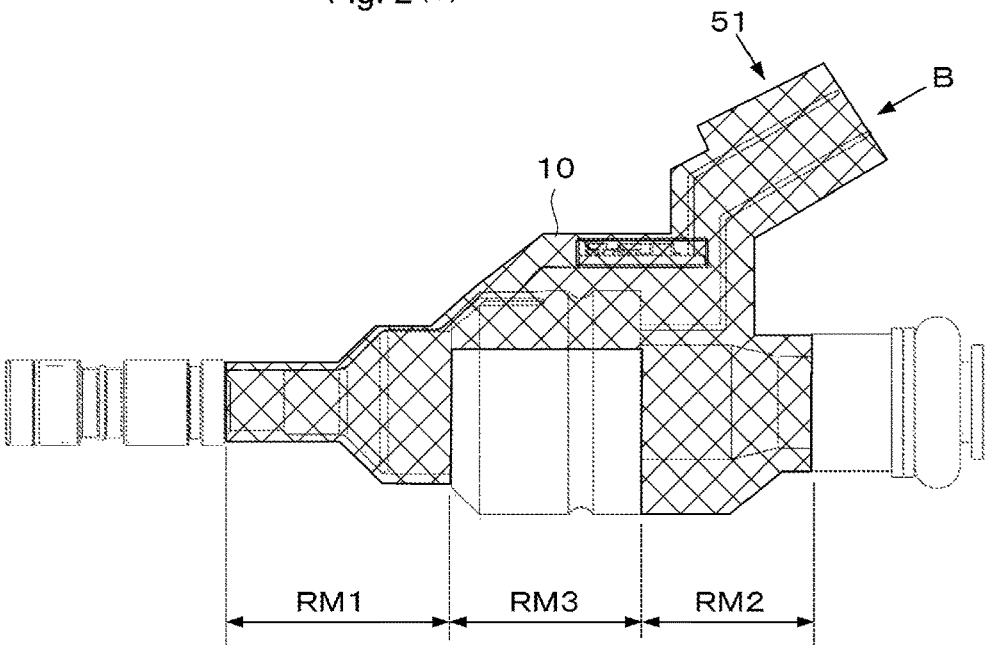
Figure 2C:
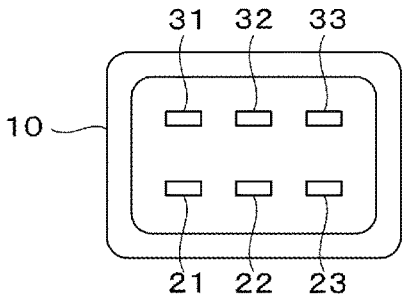

FIG. 1(*a*) is a perspective diagram showing an in-cylinder pressure detecting unit integrated fuel injection device according to one embodiment of the present invention, and FIG. 1(*b*) is a perspective diagram showing a part of the fuel injection device shown in FIG. 1(*a*). FIG. 2(*a*) is a side view of the fuel injection device shown in FIG. 1(*a*), and FIG. 2(*b*) is a drawing for illustrating a state where synthetic resin mold is covered on the fuel injection device shown in FIG. 2(*a*). FIGS. 1(*a*), 1(*b*), and FIG. 2(*a*) show, for explanation, a state where no synthetic resin mold is covered.

The in-cylinder pressure detecting unit integrated fuel injection device 100 is configured by mounting an in-cylinder pressure detecting unit 101 on the fuel injection device 1. In this embodiment, the in-cylinder pressure detecting unit integrated fuel injection device 100 is configured by integrating the in-cylinder pressure detecting unit 101 with the fuel injection device 1, and the in-cylinder pressure detecting unit integrated fuel injection device 100 is mounted on the internal combustion engine to detect the in-cylinder pressure of the internal combustion engine.

The fuel injection device 1 is a device for injecting fuel into a combustion chamber of the internal combustion engine. The fuel injection device 1 includes well-known structural elements such as a valve shaft, a solenoid (actuating circuit) for actuating the valve shaft, and a spring for energizing the valve shaft, and injects fuel from an injection port 5 disposed at the tip-portion. The fuel injection device 1 has a large diameter casing 3 made of metal and a small diameter casing 4 made of metal. The large diameter casing 3 contains the solenoid, and the tip-portion of the small diameter casing 4 is provided with the injection port 5 (refer to FIG. 11).

The in-cylinder pressure detecting unit 101 is configured by previously assembling the pressure detecting element 2, a sensor fixing member 13 having a cylindrical shape on which the pressure detecting element 2 is fixed at a tip-portion thereof, an amplifying circuit unit 11, and a connecting member 12 connecting the pressure detecting element 2 with the amplifying circuit unit 11. The in-cylinder pressure detecting unit 101 is mounted on the fuel injection device 1 by fitting the sensor fixing member 13 onto the tip-portion side (injection port 5 side) of the small diameter casing 4. Accordingly, the pressure detecting element 2 is mounted at the tip-portion (a position such that the pressure detecting element 2 surrounds the injection port 5) of the fuel injection device 1, and connected via the connecting member 12 to the amplifying circuit unit 11. The amplifying circuit unit 11 is disposed at a position slightly away from the large diameter casing 3 of the fuel injection device 1, so that a synthetic resin mold 10 exists between the amplifying circuit unit 11 and the large diameter casing 3 (refer to FIG. 2(*b*)).

Figure 3A:
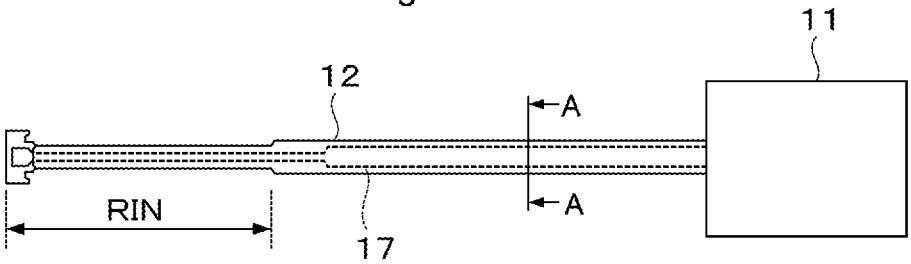
FIGS. 3(*a*) and 3(*b*) show drawings for illustrating a structure of a connecting member shown in FIGS. 1(*a*) and 1(*b*).
Figure 3B:
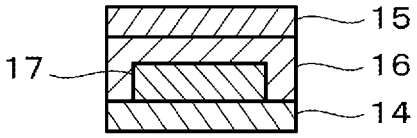

FIGS. 3(*a*) and 3(*b*) are drawings for illustrating a structure of the connecting member 12. FIG. 3(*a*) is a plane view and FIG. 3(*b*) is a sectional view of the A-A line indicated in FIG. 3(*a*). The connecting member 12 is configured by covering a copper wire 17 with adhesive 16 (epoxy resin) and coating members 14 and 15 made of polyimide.

Figure 4:
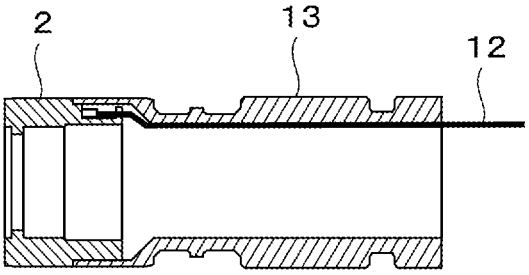
FIG. 4 is a sectional view showing a structure near a tip-portion of the in-cylinder pressure detecting unit integrated fuel injection device.

The connecting member 12 is arranged so that the vicinity of the end-portion connected to the pressure detecting element 2 (the portion indicated with RIN in FIG. 3(*a*)) passes through inside of the sensor fixing member 13 made of metal as shown in FIG. 4, and a portion between the portion indicated with RIN and the amplifying circuit unit 11 passes along the external surface of the large diameter casing 3. It is to be noted that the portion 12*a* near the connecting point with the amplifying circuit unit 11 is away from the external surface of the large diameter casing 3.

In FIGS. 1 and 2, the amplifying circuit unit 11 is shown as contained in a transparent casing for explanation. Actually, the amplifying unit 11 is configured by arranging parts electrically connected on a flexible printed wiring board and covering the parts and the flexible printed wiring board with synthetic resin mold 11*a*. This is referred to as "synthetic resin mold 11*a*" in the following description.

Connector pins 31-33 are fixed on the amplifying circuit unit 11, and the connector pins 31-33 constitute a part of a connector block 51 with connector pins 21-23 to which actuation signal wires for supplying an actuation signal to a solenoid (actuation circuit) of the fuel injection device 1. A connector member which can be fitted onto the connector pins 21-23 and 31-33 is fixed at an end-portion of connecting wires from an electronic control unit (hereinafter referred to as "ECU") 60 (refer to FIGS. 5 and 7) for controlling the fuel injection device 1. The connector member is fitted onto the connector block 51, thereby connecting the connecting wires to the connector pins 21-23 and 31-33.

The amplifying circuit unit 11 and the connecting member 12 is covered with the synthetic resin mold 10 as shown in FIG. 2(*b*) with cross-hatching. In the ranges RM1 and RM2 shown in FIG. 2(*b*), the whole outer surface of the fuel injection device 1 is covered with the synthetic resin mold 10, and in the range RM3, the vicinity of the amplifying circuit unit 11 and the connecting member 12 are covered. The connector block 51 is configured so that the connector pins 21-23 and 31-33 are exposed as shown in FIG. 2(*c*) and the connector member (not shown) fixed at the end-portion of connecting wires can be fitted. FIG. 2(*c*) is a drawing of the connector block 51 viewed from the direction indicated by the arrow B in FIG. 2(*b*).

Figure 5:
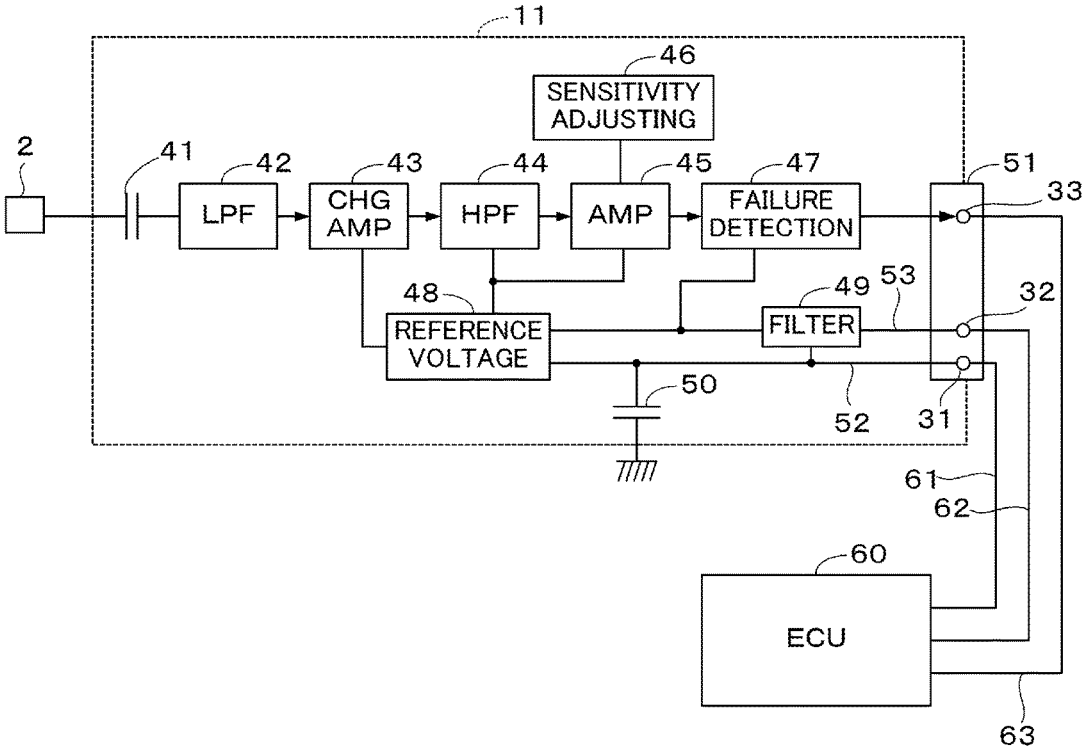
FIG. 5 is a block diagram showing a configuration of the amplifying circuit unit shown in FIGS. 1(*a*) and 1(*b*).

FIG. 5 is a block diagram showing a configuration of the amplifying circuit unit 11. The amplifying circuit unit 11 includes a capacitor 41, a low-pass filter 42, a charge amplifier 43, a high-pass filter 44, an amplifying circuit 45, a sensitivity adjusting circuit 46, a failure detection circuit, a reference voltage circuit 48, a power source noise filter 49, an alternating-current grounding capacitor 50, and the connector pins 31-33 constituting the connector block 51. The connector pin 31 is connected via a ground connection wire 61 to the ground of the ECU 60, and the direct-current voltage (e.g., 5V) is supplied via a power source connection wire 62 to the connector pin 32. The connector pin 33 is connected via a signal connection wire (detected signal wire) 63 to an AD converter in the ECU 60. A power source line 53 connected to the connector pin 32 is connected via the power source noise filter 49 to the reference voltage circuit 48.

The capacitor 41 cuts the direct-current component contained in the detection signal input through the connecting member 12 from the pressure detecting element 2, and only alternating-current components are input to the low-pass filter 42. The low-pass filter 42 eliminates unnecessary high frequency components. The charge amplifier 43 converts the input signal indicative of a pressure change rate to a pressure signal indicative of a pressure value by integrating and amplifying the input signal. The high-pass filter 44 eliminates unnecessary low frequency components. The amplifying circuit 45 amplifies the output signal from the high-pass filter 44.

The sensitivity adjusting circuit 46 is configured, for example, with a combination of a plurality of resistors, and used for adjusting a gain of the amplifying circuit 45 so that the output signal level of the amplifying circuit 45 becomes equal to a predetermined level. Specifically, the total resistance value of the plurality of resistors is adjusted by cutting a part of wiring which connects the plurality of resistors previously disposed, thereby performing the gain adjustment. It is to be noted that the gain adjustment is performed before covering the amplifying circuit unit 11 with the synthetic resin mold 11*a*.

The reference voltage circuit 48 generates a reference voltage VREF from the power source voltage VS1 supplied from the ECU 60, and supplies the reference voltage VREF to the charge amplifier 43, the high-pass filter 44, and the amplifying circuit 45. The reference voltage VREF is a voltage for offsetting the direct-current voltage (raising the direct-current voltage from 0V to 1V). The power source noise filter 49 is a low-pass filter for removing noises entering via the power source connection wire 62.

The ground line 52 of the amplifying circuit unit 11 is connected via the connector block 51 and the ground connection wire 61 to the ground of the ECU 60. The ground line 52 is connected via the alternating-current grounding capacitor 50 to the housing of the fuel injection device 1, but not directly connected the housing of the fuel injection device 1. This configuration makes it possible for the ECU 60 to detect disconnection of the ground connection wire 61, as described below. It is to be noted that the housing of the fuel injection device 1 is conductively connected to the cylinder head of the internal combustion engine.

Figure 6:
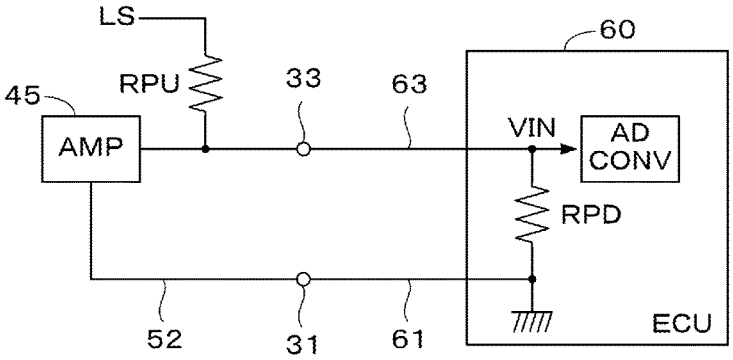
FIG. 6 is a drawing for illustrating a failure detection circuit.

The failure detection circuit 47 is configured, as shown in FIG. 6, by connecting a pull-up resistor RPU to the power source line LS. The ECU 60 is provided with a pull-down resistor RPD connected to the ground so that disconnection or grounding of the power source connection wire 62 or the signal connection wire 63 is detectable, or disconnection of the ground connection wire 61 is detectable, according to the input DC voltage VIN. Specifically, if disconnection or grounding of the connection wire 62 or 63 occurs, the input DC voltage VIN becomes "0", and if disconnection of the ground connection wire 61 occurs, the input DC voltage VIN becomes higher than the normal voltage VNL. Accordingly, it is possible to determine that disconnection of the ground connection wire 61 occurs if the input DC voltage VIN becomes equal to or higher than a predetermined voltage.

Figure 7:
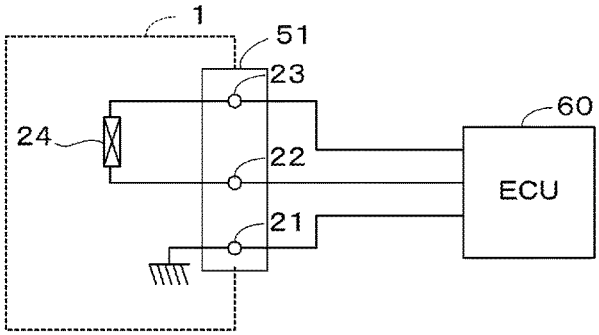
FIG. 7 is a drawing for illustrating connection between an actuation solenoid of the fuel injection device and an electronic control unit.

FIG. 7 is a drawing for illustrating connection between an actuation solenoid 24 of the fuel injection device 1 and the ECU 60. Both ends of the solenoid 24 are connected via the connector pins 22 and 23 of the connector block 51 to the ECU 60, and the connector pin 21 is grounded to the housing of the fuel injection device 1.

As described above, in this embodiment, the in-cylinder pressure detecting unit integrated fuel injection device 100 is configured by integrating the in-cylinder pressure detecting unit 101 including the pressure detecting element 2, the amplifying circuit unit 11, and the connecting member 12, with the fuel injection device 1, and the in-cylinder pressure detecting unit integrated fuel injection device 100 is mounted on the internal combustion engine. Accordingly, the amplifying circuit unit 11 is disposed near the pressure detecting element 2, thereby reducing the influence from the actuation signal of the fuel injection device 1. Further, it is possible to mount the fuel injection device 1 with the in-cylinder pressure detecting unit 101 on the internal combustion engine with working similar to that for mounting the fuel injection device without the pressure detecting unit, which makes it possible to enhance workability when mounting the fuel injection device 1 with the in-cylinder pressure detecting unit 101.

Further, the in-cylinder pressure detecting unit 101 is configured by previously assembling the sensor fixing member 13 on which the pressure detecting element 2 is fixed, the amplifying circuit unit 11, and the connecting member 12 connecting the pressure detecting element 2 with the amplifying circuit unit 11. Next, by fitting the sensor fixing member 13 onto the tip-portion of the fuel injection device 1, the in-cylinder pressure detecting unit integrated fuel injection device 100 is configured. Accordingly, it is possible to enhance workability when integrating the in-cylinder pressure detecting unit 101 with the fuel injection device 1.

Further, the amplifying circuit unit 11 is covered with the synthetic resin mold 11*a*, which makes it possible to prevent circuit elements of the amplifying circuit unit 11 from failing when next covering and fixing the amplifying circuit unit 11 with the synthetic resin mold 10. The amplifying circuit unit 11 is covered with the synthetic resin mold 10 and fixed on the outside of the large diameter casing 3 which contains the actuation circuit (solenoid 24) of the fuel injection device 1. Accordingly, handling of the amplifying circuit unit 11 integrated with the fuel injection device 1 can be made easier, and effects of waterproof, heat insulation, and electric insulation of the amplifying circuit unit 11 can surely be obtained.

Further, the connector pins 31-33 for connecting the wires provided between the amplifying circuit unit 11 and the control unit 60 are included in the connector block 51 to which the actuation signal wires for the fuel injection device 1 are connected. This enables performing the power source supply to the amplifying circuit unit 11, transmission of the pressure detection signal, and transmission of the fuel injection device actuation signal via one connector. Accordingly, it is possible to make the assembling work easier and to reduce the size of the in-cylinder pressure detecting unit integrated fuel injection device 100.

The failure detection circuit 47 of the amplifying circuit unit 11 includes the pull-up resistor RPU, and the ground line 52 of the amplifying circuit unit 11 is not directly connected to the housing of the fuel injection device 1, but is connected via the ground connection wire 61 to the ground of the ECU 60. This makes it possible for the ECU 60 to detect not only disconnection or grounding of the connection wires 62 and 63 but also disconnection of the grounding wire 61.

Further, the sensitivity adjustment can be performed in the state where the pressure detecting element 2 and the amplifying circuit unit 11 are assembled before mounting the in-cylinder pressure detecting unit 101 on the engine. The charge amplifier 43 integrates and amplifies the output signal from the pressure detecting element 2, and the pressure detection signal is thereby obtained. It is confirmed that the detecting sensitivity takes different values due to differences in characteristics of the pressure detecting elements 2, the charge amplifiers 43, etc. Accordingly, by performing the gain adjustment of the amplifying circuit 45 in the state where the pressure detecting element 2, the charge amplifier 43, and the amplifying circuit 45 are assembled, it is possible to remove the influence of characteristic differences among pressure detecting elements 2 as well as to remove the influence of characteristic differences among the charge amplifiers 43 and the amplifying circuits 45, to accurately perform the pressure detection.

Further, since the amplifying circuit unit 11 includes the noise filter 49 for eliminating noises entering the power source line for supplying the power source, it is possible to surely prevent noises from entering the pressure detection signal via the power source line.

Further, since the amplifying circuit unit 11 is configured on a flexible printed wiring board, the size of the amplifying circuit unit 11 is made to be smaller, which can make it easier to mount the amplifying circuit unit 11 on the fuel injection device 1.

Modification

Figure 8:
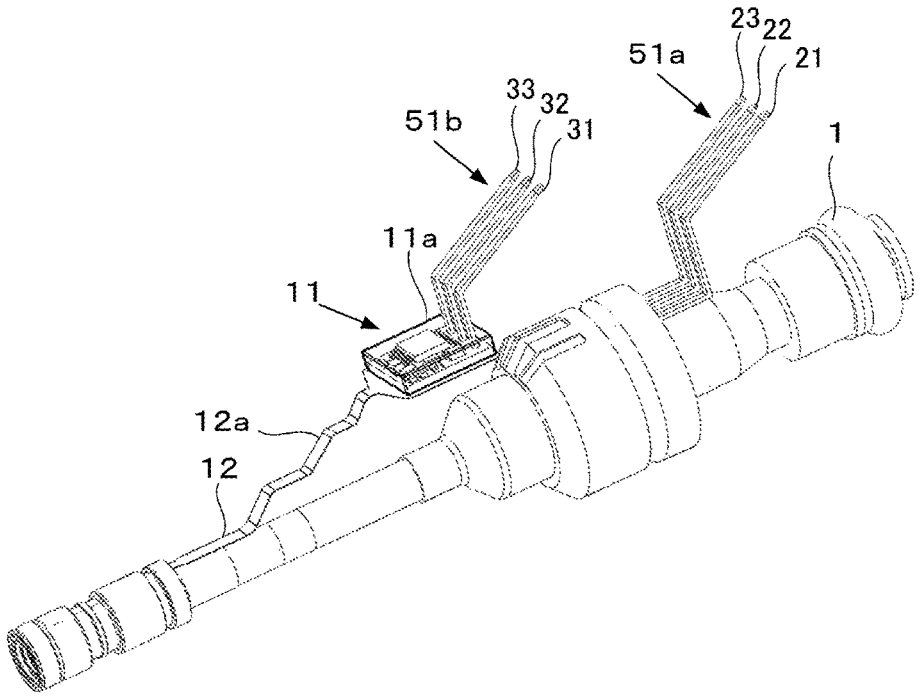
FIG. 8 is a perspective diagram showing a modification of the structure shown in FIGS. 1(*a*) and 1(*b*).

In the above-described embodiment, the connector block 51 is configured by disposing the amplifying circuit unit 11 near the connector pins 21-23 of the fuel injection device 1 and integrating the connector pins 31-33 of the amplifying circuit unit 11 with the connector pins 21-21. Alternatively, as shown in FIG. 8, the amplifying circuit unit 11 may be disposed at a position slightly away from a main-body connector block 51*a* containing the connector pins 21-23 of the fuel injection device 1, and another sub-connector block 51*b* may be provided for the connector pins 31-33 of the amplifying circuit unit 11.

By providing the connector block 51*b* separately from the connector block 51*a*, the detection signal wire 63 for transmitting the pressure detection signal is positioned away from the actuation signal wire through which a comparatively large current flows. Accordingly, it is possible to reduce the influence of the actuation signal of the fuel injection device 1 acting on the in-cylinder pressure detection signal.

Further, the synthetic resin mold 10 and 11*a* may be replaced with ceramic mold. The amplifying circuit unit 11 may be fixed on the outer surface of the large diameter casing 3 of the fuel injection device 1 in the state where the amplifying circuit unit 11 is contained in a metal casing other than the large diameter casing 3.

Further, instead of the power source noise filter 49, a signal noise filter (low-pass filter) for eliminating noise components may be disposed between the failure detection circuit 47 and the connector pin 33, or both of the power source noise filter 49 and the signal noise filter may be provided.

Further, in the above-described embodiment, the sensitivity adjusting circuit 46 is configured with a combination of a plurality of resistors. Alternatively, the gain adjustment may be performed by writing gain adjustment data in a non-volatile memory, for example.

Further, the amplifying circuit unit 11 may be configured on a glass epoxy resin substrate, and the connecting member 12 may be connected to the glass epoxy resin substrate.

Next, the state where the in-cylinder pressure detecting unit integrated fuel injection device 100 is mounted on the internal combustion engine, and the configuration of the in-cylinder pressure detecting unit integrated fuel injection device 100, are more specifically described with reference to FIGS. 9 to 16. It is to be noted that the in-cylinder pressure detecting unit integrated fuel injection device 100 is hereinafter referred to simply as the fuel injection device 100.

Figure 9:
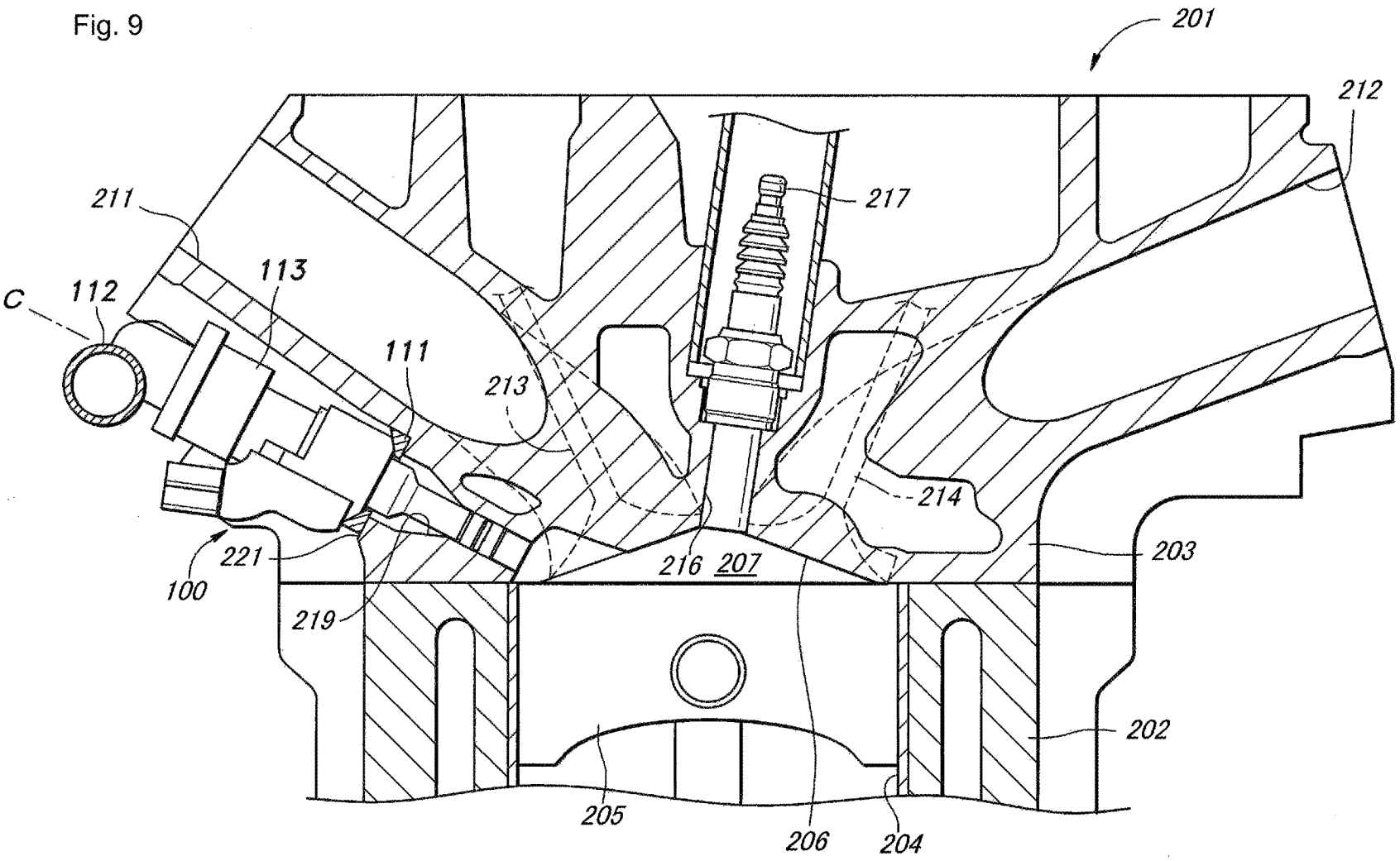
FIG. 9 is a sectional view of an internal combustion engine provided with the in-cylinder pressure detecting unit integrated fuel injection device.

As shown in FIG. 9, the internal combustion engine 201 of an automobile has a cylinder block 202 and a cylinder head 203 bonded to the upper part of the cylinder block 202. A plurality of cylinders 204 are formed in the cylinder block 202, and each cylinder 204 is provided with a piston 205 slidably fitted along the axis of the cylinder 204. A combustion chamber recess 206 is formed substantially in a semispherical shape at the portion of the cylinder head 203 facing the cylinder 204. The combustion chamber recess 206 and the upper surface of the piston 205 define the combustion chamber 207.

A pair of intake ports 211 opens on one side of the combustion chamber recess 206. Each intake port 211 extends from the combustion chamber recess 206 to the side wall on one side of the cylinder head 203, and opens at the side wall. A pair of exhaust ports 212 opens on the other side of the combustion chamber recess 206. Each exhaust port 212 extends from the combustion chamber recess 206 to the side wall on the other side of the cylinder head 203, and opens at the side wall. The boundary portions between the combustion chamber recess 206 and each intake port 211 and each exhaust port 212 are respectively provided with an intake valve 213 and an exhaust valve 214 which are poppet valves for opening and closing each port. A spark plug mounting hole 216 is formed at the center portion of the combustion chamber recess 206 surrounded by the intake ports 211 and the exhaust ports 212, the spark plug mounting hole passing axially through the cylinder head 203. A spark plug 217 is inserted into the spark plug mounting hole 216 and fixed.

One end (inner end) of an injector hole 219 opens at a peripheral portion between the pair of intake ports 211 on the one side of the combustion chamber recess 206. The injector hole 219 extends along the straight axis C and the other end (outer end) of the injector hole 219 opens at a side wall on the one side of the cylinder head 203. The outer end of the injector hole 219 is positioned on the cylinder block 202 side with respect to the intake port 211 at the side wall of the one side. The periphery of the outer end of the injector hole 219 is formed as a mounting seat 221 which has a flat surface orthogonally crossing the axis C of the injector hole 219. The injector hole 219 has a circular cross section, and the injector hole 219 is formed so that the diameter at the inner end is smaller than the diameter of the outer end and the diameter continuously changes from the inner end to the outer end. As described above, the injector hole 219 is configured so as to penetrate through the cylinder head 203 and communicate the combustion chamber 207 with the outside of the cylinder head 203.

The fuel injection device (injector) 100 is inserted into the injector hole 219 and is fixed along the axis C. One end of the fuel injection device 100 along the axis C is referred to as "tip end" and the other end of the fuel injection device 100 is referred to as "base end". The fuel injection device 100 is inserted into the injector hole 219 so that the tip end of the fuel injection device 100 faces the combustion chamber 207 and the base end protrudes from the injector hole 219 toward the outside of the cylinder head 203.

Figure 10:
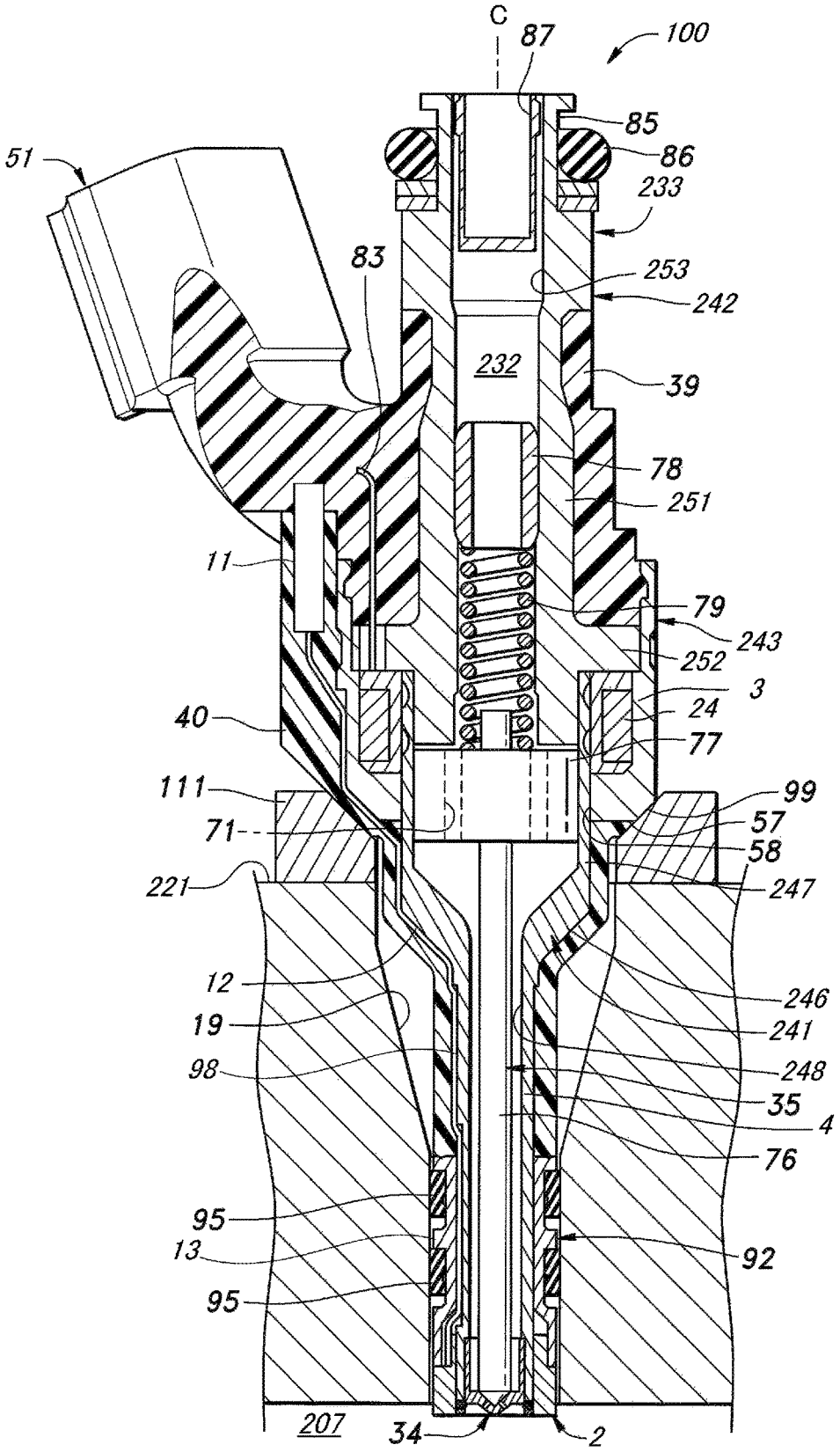
FIG. 10 is a sectional view of the in-cylinder pressure detecting unit integrated fuel injection device.

As shown in FIG. 10, the fuel injection device 100 has a valve body 233 in which a fuel passage 232 is formed, a nozzle member 34 disposed at the tip-portion of the valve body 233, a valve shaft 35 movably contained in the fuel passage 232, the solenoid 24 for actuating the valve shaft 35, and the pressure detecting element 2 disposed at the outer periphery of the tip-portion of the valve body 233. A first resin block 39 and a second resin block (covering material) 40 are insert-molded on the outer surface of the valve body 233. The first and second resin block 39 and 40 correspond to the synthetic resin mold 10 schematically shown in FIGS. 2(*a*)-2(*c*).

The valve body 233 has a first body 241, a second body 242, and a third body 243. The first to third bodies 241-243 are made of magnetic material having conductivity of electricity. The first body 241 extends coaxially with the axis C of the fuel injection device 100, and has a small diameter portion (the small diameter casing) 4, a tapered portion 246, and a large diameter portion 247 consecutively from the tip end to the base end. The small diameter portion 4, the tapered portion 246, and the large diameter portion 247 respectively have a circular cross section and are disposed coaxially with each other. The diameter of the large diameter portion 247 is larger than that of the small diameter portion 4, and the diameter of the tapered portion 246 gradually increases from the tip end side to the base end side. The first body 241 has a first port 248 penetrating coaxially with the axis C from the tip end to the base end. The inner diameter of the first port 248 on the large diameter portion 247 side is formed larger than that of the first port 248 on the small diameter portion 4 side.

The second body 242 has a spindle portion 251 and a flange portion 252. The spindle portion 251 extends coaxially with the axis C of the fuel injection device 100. The flange portion 252 has a circular disc form protruding from a part of the outer periphery of the spindle portion 251, the part of the outer periphery being positioned a predetermined distance away from the tip end of the spindle portion 251. The tip end of the spindle portion 251 is inserted into the large diameter portion 247 of the first body 241 so that the second body 242 is coaxially combined with the first body 241. The flange portion 252 of the second body 242 abuts on the end surface on the base end side of the large diameter portion 247 of the first body 241, which defines the insertion depth of the second body 242 into the first body 241. A second port 253 coaxially penetrating the spindle portion 251 from the base end to the tip end is formed in the spindle portion 251. The first port 248 and the second port 253 communicate with each other by combining the first body 241 and the second body 242, thereby constituting the fuel passage 232.

The third body 243 has a cylinder portion (large diameter casing) 3 of cylindrical shape, and an end wall portion 57 disposed for partially closing one end of the cylinder portion 3. An insertion hole 58 is formed at the center of the end wall portion 57 coaxially with the cylinder portion 3, the insertion hole 58 being a through hole having a circular cross section. The diameter of the inner periphery of the cylinder portion 3 is stepwise enlarged at the open end side for receiving the flange portion 252 of the second body 242. The third body 243 is arranged so that the end wall portion 57 is positioned on the tip end side with respect to the cylinder portion 3. The third body 243 is assembled coaxially with the first body 241 and the second body 242 by inserting the large diameter portion 247 of the first body 241 to the insertion hole 58 and inserting the flange portion 252 of the second body 242 to the cylinder portion 3. The position of the third body 243 relative to the first and second bodies 241 and 242 is fixed by the flange portion 252 abutting on the flat surface (not shown) formed on the inner periphery of the cylinder portion 3. Consequently, on the outer periphery side of the large diameter portion 247 of the first body 241, a solenoid chamber is annularly defined by the cylinder portion 3, the end wall portion 57, and the flange portion 252. The first to third bodies 241-243 are jointed to each other by welding at appropriate points.

Figure 11:
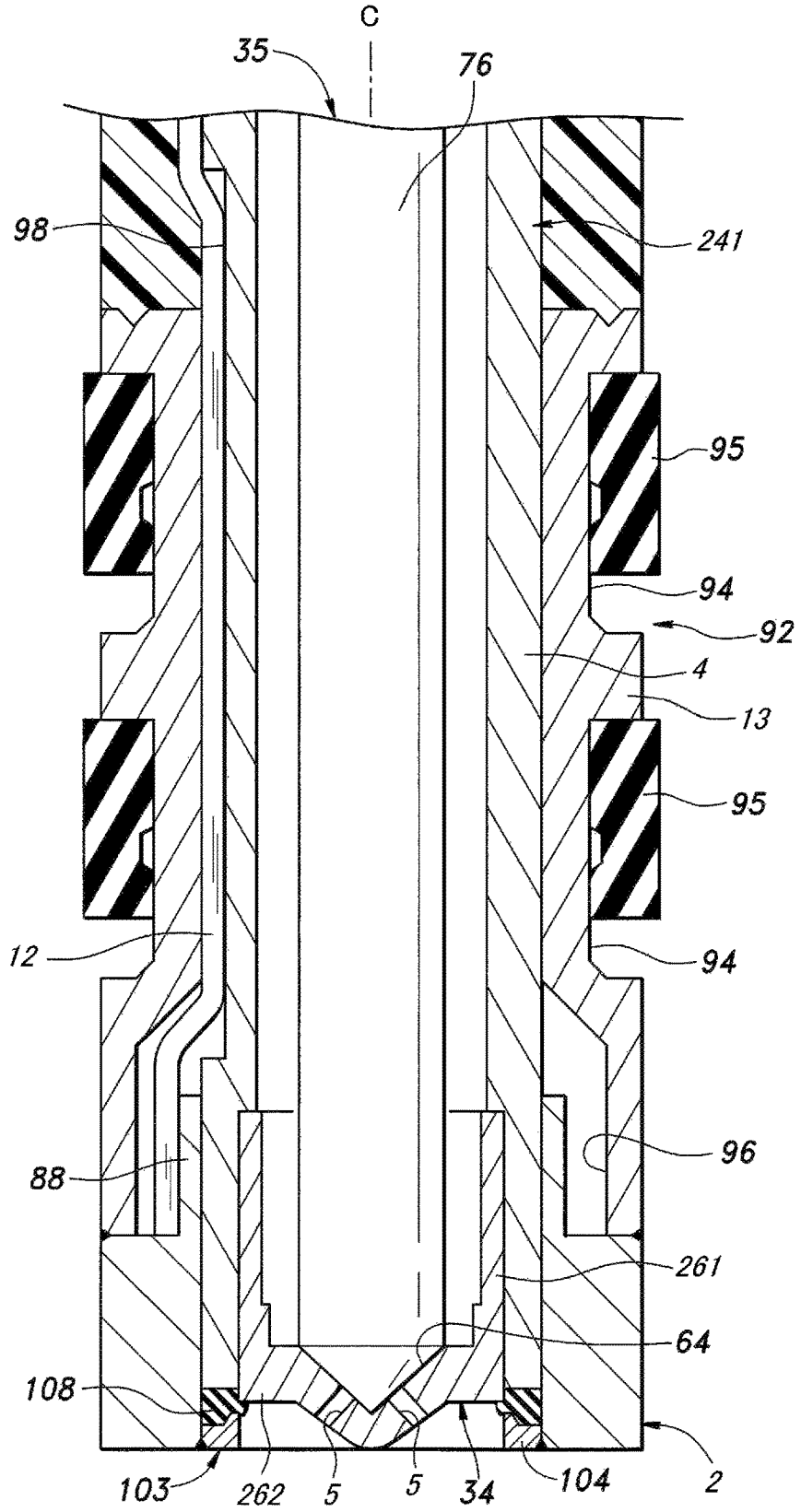
FIG. 11 is an expanded sectional view of the tip-portion of the in-cylinder pressure detecting unit integrated fuel injection device.
Figure 12:
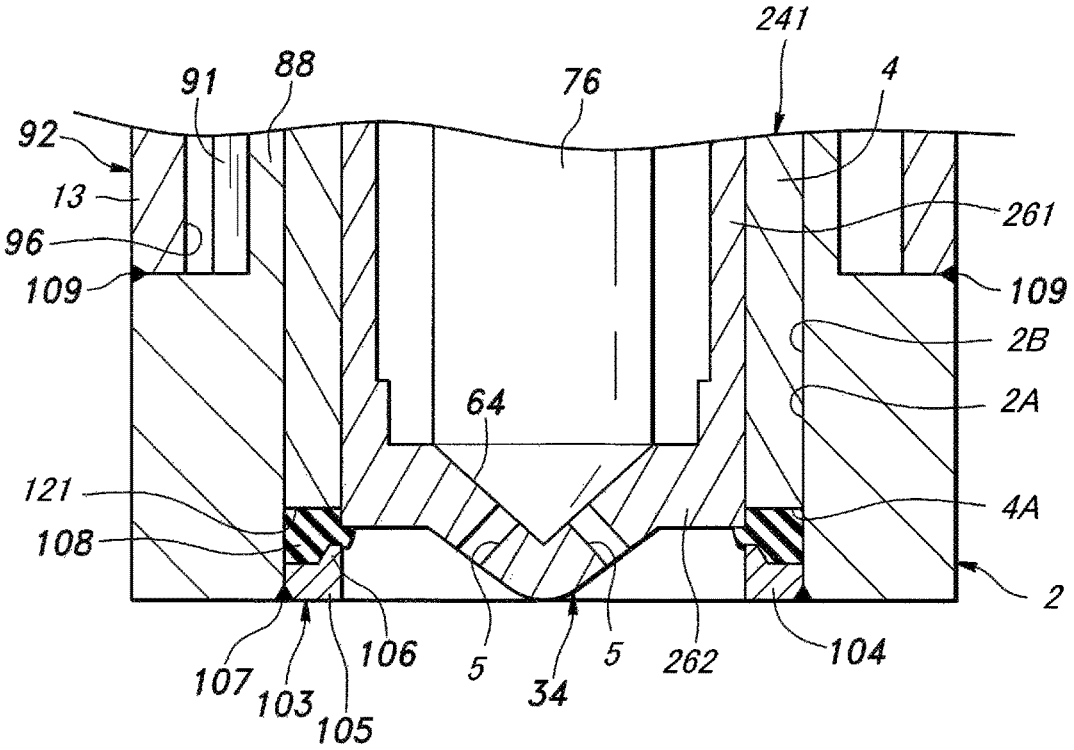
FIGS. 12(A) and 12(B) show a sectional view indicative of a final state where a pressure detecting element is mounted on a small diameter portion of a first body, and a sectional view indicative of a state immediately before the final state where the pressure detecting element is mounted on the small diameter portion of the first body.
Figure 12:
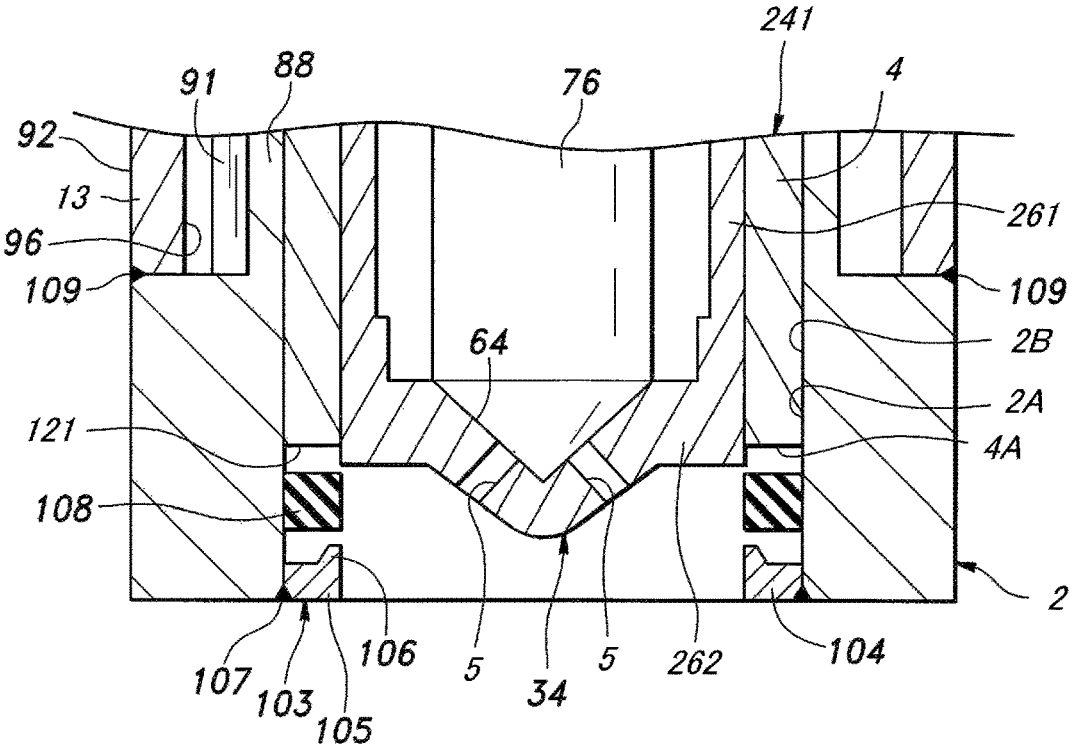

As shown in FIG. 11 and FIG. 12(A), the nozzle member 34 has a peripheral wall 261 of cylindrical shape and a bottom wall 262 closing one end of the peripheral wall 261, i.e., the nozzle member 34 is formed in cup-shape. The peripheral wall 261 of the nozzle member 34 is fitted into the open end of the first port 248 on the tip end side so that the bottom wall 262 is positioned on the tip end side with respect to the peripheral wall 261. The tip end of the peripheral wall 261 is welded to the tip end of the small diameter portion 4, thereby jointing the nozzle member 34 to the first body 241. The center part of the bottom wall 262 semi-circularly projects toward the tip end, and the inner surface (on the base end side) of the projected part is recessed to form a valve seat 64. A plurality of injection ports 5 is formed to penetrate the bottom wall 262 at the center part of the bottom wall 262.

As shown in FIG. 10, the valve shaft 35 has a rod 76 extending along the axis C in the first port 248, and an enlarged-diameter portion 77 formed on the rod 76. The diameter of the enlarged-diameter portion 77 is larger than the inner diameter of the end portion on the tip end side of the second port 253, so that the end surface of the spindle portion 251 can abut on the enlarged-diameter portion 77. The tip end of the rod 76 is shaped so as to be able to seat on the valve seat 64 formed on the nozzle member 34. A plurality of fuel ports 71 extending in parallel to the axis C is formed to penetrate the enlarged-diameter portion 77. Accordingly, the first port 248 communicates with the second port 253 via the plurality of fuel ports 71. The valve shaft 35 is made of magnetic material.

A spring seat 78 of cylindrical shape is pressed in the second port 253 and fixed. A first spring 79 is disposed between the spring seat 78 and the enlarged-diameter portion 77 of the valve shaft 35. The valve shaft 35 is energized toward the tip end by the first spring 79. Accordingly, the tip end of the rod 76 sits on the valve seat 64 to close the injection port 5.

The solenoid (coil) 24 is disposed in the solenoid chamber, the solenoid 24 being formed in an annular shape of which the center coincides with the axis C. Both ends of the winding constituting the solenoid 24 are connected respectively to solenoid wires 83. The solenoid wires 83 pass through the through holes formed in the flange portion 252 to reach the outside of the valve body 233 on the base end side. Most part of the solenoid wires 83 are bundled to extend in integrated state.

An O-ring groove 85 is formed annularly along the circumferential direction of the spindle portion 251 at the outer periphery on the base end side of the spindle portion 251. An O-ring 86 having flexibility is mounted in the O-ring groove 85. A filter 87 for removing foreign substances contained in fuel is mounted at the open end on the base end side of the second port 253.

The pressure detecting element 2 has, not specifically shown, a casing constituting the outer shell and a piezoelectric element contained in the casing. The pressure detecting element 2 is formed in a cylindrical shape which opens at both ends. The outer shell of the pressure detecting element 2 is made of, for example, metallic material. As shown in FIG. 11 and FIG. 12(A), the pressure detecting element 2 has an inner hole 2B defined by an inner peripheral surface 2A having circular cross section. The inner hole 2B is a through hole, into which the tip end of the small diameter portion 4 is inserted from the open end on the base end side. The small diameter portion 4 is tightly fitted in the inner hole 2B, and the pressure detecting element 2 is mounted on the outer periphery of the tip end part of the small diameter portion 4.

In the state where the pressure detecting element 2 is mounted on the small diameter portion 4, the tip end portion of the pressure detecting element 2 extends further from the tip end surface 4A of the small diameter portion 4 toward the tip end side (combustion chamber side). In other words, the tip end surface 4A of the small diameter portion 4 is positioned inside the inner hole 2B of the pressure detecting element 2. A corner 121 is thereby defined with the inner peripheral surface 2A of the pressure detecting element 2 and the tip end surface 4A of the small diameter portion 4, as shown in FIGS. 12(A) and 12(B).

A locking block 103 protruding toward the inner side in the radial direction is disposed on the inner peripheral surface 2A of the tip end portion of the pressure detecting element 2. In this embodiment, the locking block 103 extends in the circumferential direction along the inner peripheral surface 2A. The locking block 103 may be formed in one body with the pressure detecting element 2. Alternatively, an annularly-shaped member 104 constituting the locking block 103 may be combined with the pressure detecting element 2.

In this embodiment, the locking block 103 is constituted with the annularly-shaped member 104 which is configured separately from the pressure detecting element 2. The annularly-shaped member 104 has a main part 105 of annular shape and a wall part 106. The cross section of the main part 105 is squarely formed. The wall part 106 protrudes from the inner periphery of the main part 105 and is annularly formed along the inner periphery of the main part 105. Specifically, the wall part 106 has an inner surface annularly formed coaxially with the axis of the main part 105, and an outer surface which is a tapered surface inclining toward the inner side in the radial direction.

The annularly-shaped member 104 is inserted into the inner hole 28 of the pressure detecting element 2, and abuts on the inner peripheral surface 2A at the outer periphery. In this state, the end surface on the tip end side of the main part 105 is positioned so as to substantially coincide with the tip end surface of the pressure detecting element 2. Further, the wall part 106 is arranged so as to face the inner side of the inner hole 2B.

The annularly-shaped member 104 is jointed with the pressure detecting element 2 by welding or the like. The welding of the annularly-shaped member 104 and the pressure detecting element 2 may be performed with respect to all over the outer periphery of the annularly-shaped member 104 continuously or intermittently. The welding of the annularly-shaped member 104 and the pressure detecting element 2 is performed before determining the pressure detection characteristic of the pressure detecting element 2. In other words, the calibration work of the pressure detecting element 2 is performed after the welding. Accordingly, if residual stress due to thermal deformation caused by the welding of the annularly-shaped member 104 and the pressure detecting element 2, exists in the pressure detecting element 2, the stress gives no influence to detection accuracy of the pressure detecting element 2. In this embodiment, the tip end of the outer periphery of the main part 105 is welded at all over the periphery to the tip end of the inner peripheral surface 2A of the pressure detecting element 2, thereby forming the welded part 107.

In the state where the pressure detecting element 2 is mounted on the small diameter portion 4, the main part 105 and the wall part 106 of the locking block 103 extend so that the main part 105 and the wall part 106 overlap with the tip end surface 4A of the small diameter portion 4 in the axis C direction view. A seal member 108 is held between the tip end surface 4A of the small diameter portion 4 and the locking block 103. The seal member 108 is made of material having flexibility and heat resistance, e.g., fluoric resin such as polytetrafluoroethylene. As shown in FIG. 12(B), the seal member 108 is annularly configured, and has square cross section in the state where no force is acted on. The seal member 108 is arranged along the annularly-extending corner 121 which is defined by the inner peripheral surface 2A of the pressure detecting element 2 and the tip end surface 4A of the small diameter portion 4.

As shown in FIG. 12(A), the seal member 108 is deformed by being compressed with the locking block 103 and the tip end surface 4A of the small diameter portion 4 in the axis C direction. The deformed seal member 108 adheres to the locking block 103, the tip end surface 4A of the small diameter portion 4, and the inner peripheral surface 2A to cover the corner 121, thereby air-tightly sealing the gap between the inner peripheral surface 2A of the pressure detecting element 2 and the outer periphery of the small diameter portion 4. The wall part 106 of the locking block 103 suppresses projection of the seal member 108 toward the inner side in the radial direction and maintains the seal member 108 at the corner 121, the seal member 108 being deformed with the compressing force. Further, the wall part 106 reduces an area of the seal member 108 being exposed to the combustion chamber 207 by covering the inner side of the seal member 108 in the radial direction, thereby reducing the area of the seal member 108 contacting high temperature gases in the combustion chamber 207. Accordingly, deterioration of the seal member 108 due to heat is prevented. Preferably, the projection end of the wall part 106 is positioned near the tip end surface 4A of the small diameter portion 4, and may abut on the tip end surface 4A of the small diameter portion 4.

In this embodiment, the nozzle member 34 protrudes from the tip end surface 4A of the small diameter portion 4, and a side wall is formed by the outer surface of the peripheral wall 261 of the nozzle member 34 at the boundary between the nozzle member 34 and the small diameter portion 4. The peripheral wall 261 abuts on the seal member 108 to suppress the projection of the seal member 108 toward the inner side in the radial direction.

As shown in FIG. 11, the outer diameter of the base end portion of the pressure detecting element 2 is reduced stepwise, thereby forming a connection block 88. The connecting member 12 for transmitting the electric signal extends from the connection block 88.

A sealing device 92 is jointed with the base end portion of the pressure detecting element 2. The sealing device 92 includes the sensor fixing member 13 of cylindrical shape through which the small diameter portion 4 passes. The tip end portion of inner periphery of the sensor fixing member 13 is stepwise enlarged in its diameter, thereby forming a receiving part 96. The connection block 88 projects into the receiving part 96 and the receiving part 96 covers the outer surface of the connection block 88. The pressure detecting element 2 and the tip end of the sensor fixing member 13 are welded together at a welded part 109. The welding of the sensor fixing member 13 and the pressure detecting element 2 is performed before the pressure detection characteristic of the pressure detecting element 2 is determined.

Two seal grooves 94 are annularly formed on the outer periphery of the sensor fixing member 13, the seal grooves 94 extending in the circumferential direction. A seal member (chip seal) 95 of annular shape is mounted on each seal groove 94. The sealing device 92 is mounted on the tip end portion of the outer periphery of the small diameter portion 4 in the state where the pressure detecting element 2 is mounted on the tip end of the small diameter portion 4.

Sequence of assembling the pressure detecting element 2, the seal member 108, and the sealing device 92 with the fuel injection device 100 is described below. Firstly, the annularly-shaped member 104 configuring the locking block 103 and the sealing device 92 are welded to the pressure detecting element 2 to constitute an assembled pressure detecting element 2. The connecting member 12 passes through the inside of the sensor fixing member 13 to be exposed from the base end of the sensor fixing member 13. In this state, the detecting characteristic of the pressure detecting element 2 is determined. The tip end of the small diameter portion 4 is inserted into the assembled pressure detecting element 2 so that the small diameter portion 4 passes through the assembled pressure detecting element 2, and the assembled pressure detecting element 2 is tightly fitted onto the small diameter portion 4. At this time, as shown in FIG. 12(B), the seal member 108 is disposed between the tip end surface 4A of the small diameter portion 4 and the locking block 103, thereby making the seal member 108 be held between the tip end surface 4A and the locking block 103. The sealing device 92 is jointed to the small diameter portion 4 with the pressure detecting element 2 which is tightly fitted onto the small diameter portion 4.

As shown in FIG. 10, a first receiving groove 98 extending in the direction of the axis C from the small diameter portion 4 via the tapered portion 246 to the large diameter portion 247, is provided on the outer surface of the first body 241. The first receiving groove 98 is formed deeply at a portion of the small diameter portion 4 facing the sensor fixing member 13. The deeply-formed portion of the first receiving groove 98 extends from a position on the tip end side corresponding to the receiving part 96 to a position on the base end side with respect to the end of the sensor fixing member 13.

The connecting member 12 extends from the connection part 88 of the pressure detecting element 2 through the first receiving groove 98 to the base end side of the sealing device 92, to reach the base end of the small diameter portion 4. The connecting member 12 is covered with epoxy resin adhesive and adhered to the surface of the valve body 233.

As shown in FIG. 10, the first resin block 39 is molded on the outer surface of the spindle portion 251, and the second resin block 40 is molded on the outer surface of the first body 241, the second body 242, and the first resin block 39. The first resin block 39 covers the part from the flange portion 252 to the base end of the spindle portion 251, and protrudes outward to form the connector block 51. The connecting member 12 is connected to the amplifying circuit unit 11 and the solenoid wire 83 extends through the first resin block 39 to the connector block 51.

The fuel injection device 100 configured as described above is arranged as shown in FIG. 9 so that the first body 241 is positioned in the injector hole 219 and the third body 243 is positioned outside the injector hole 219. A tolerance ring 111 of annular shape is disposed coaxially with the injector hole 219 on a mounting seat 221 located at the outer end periphery of the injector hole 219. The tolerance ring 111 has conductivity of electricity, and the inner surface of the tolerance ring 111 is formed as tapered surface so that the inner surface can abut on the tapered surface 99 of the third body 243. Accordingly, the valve body 233 is electrically connected via the tolerance ring 11 to the cylinder head 203 to be grounded.

The fuel injection device 100 is arranged so that the tip end of the first body 241 and the pressure detecting element 2 face the combustion chamber 207, the tip end of the first body 241 being provided with the nozzle member 34. Each of the seal member 95 of the sealing device 92 abuts on the inner surface of the injector hole 219, and seals the gap between the injector hole 219 and the sensor fixing member 13. The sensor fixing member 13 is air-tightly combined with the pressure detecting element 2, and the gap between the pressure detecting element 2 and the small diameter portion 4 of the valve body 233 is air-tightly sealed with the seal member 108. As shown in FIG. 9, the base end of the spindle portion 251 is inserted into a connecting pipe 113 connected to a delivery pipe 112, thereby connecting the spindle portion 251 to the delivery pipe 112, wherein the base end of the spindle portion 251 constitutes the base end of the valve body 233, and the delivery pipe 112 supplies fuel to the fuel injection device 100. The O-ring 86 seals the gap between the spindle portion 251 and the connecting pipe 113. With this configuration, fuel is supplied from the delivery pipe 112 through the connecting pipe 113 to the fuel passage 232 comprising the first port 248 and the second port 253.

As described above, in this embodiment, the gap between the inner peripheral surface 2A of the pressure detecting element 2 and the outer surface of the small diameter portion 4 of the valve body 233 is sealed with the seal member 108. Accordingly, it is not necessary to tightly closing the gap by welding, which prevents changes in the detection characteristic of the pressure detecting element 2 caused by the welding heat. The locking block 103 holding the seal member 108 together with the tip end surface 4A of the small diameter portion 4, has the wall part 106 on the inner periphery and restricts movement of the seal member 108 which deforms due to the compression force. Consequently, the seal member 108 is maintained at the corner 121 at which the gap between the pressure detecting element 2 and the small diameter portion 4 opens, and can surely seal the gap.

Further, the wall part 106 covers the inner periphery of the seal member 108, thereby reducing the area of the seal member 108 exposed to the combustion chamber 207 and suppressing contact of the seal member 108 with the high temperature gases in the combustion chamber 207. Accordingly, deterioration of the seal member 108 is suppressed.

First to fourth modifications in which a part of the above-described embodiment is modified are described below. Fuel injection devices 200, 300, and 400 according to the first to third modifications are partially different from the fuel injection device 100 of the above-described embodiment, and are mostly similar to the fuel injection device 100. Accordingly, in the following description of the fuel injection devices 200, 300, and 400, the components similar to those of the fuel injection device 100 are shown with the same reference numbers, and the description is omitted.

The first to fourth modifications are described with reference to FIGS. 13 to 16.

Figure 13:
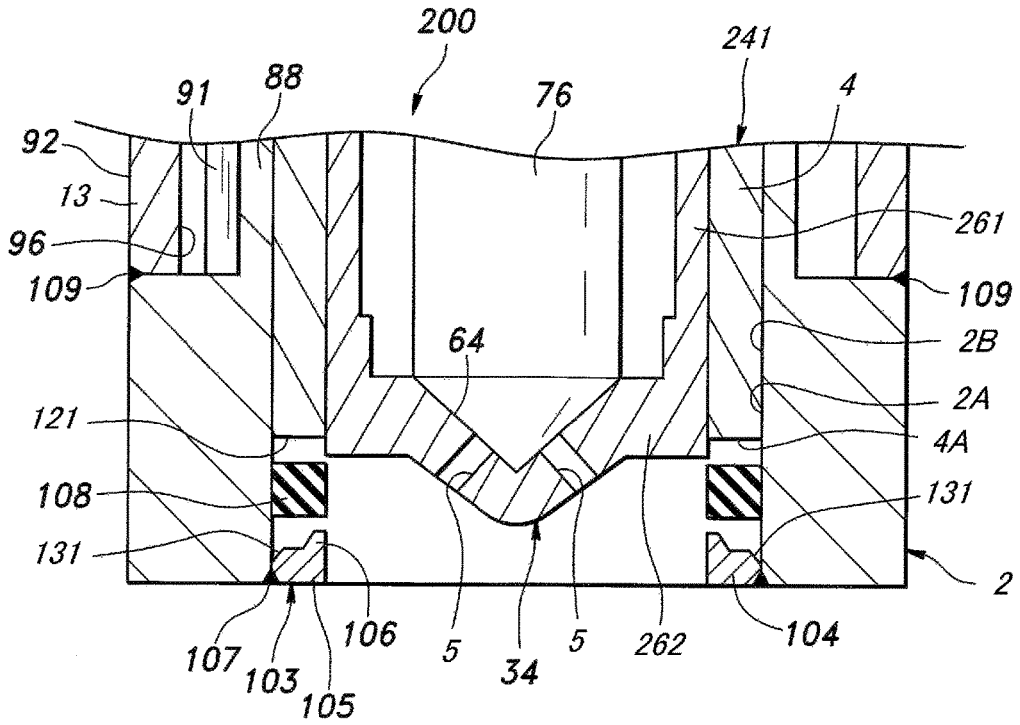
FIG. 13 shows a sectional view indicative of a state immediately before the final state where the pressure detecting element is mounted on the small diameter portion of the first body in a first modification.

As shown in FIG. 13, the fuel injection device 200 according to the first modification, a groove (notch) 131 is formed at the outer periphery of the main part 105 of the locking block 103, the outer periphery facing the tip end surface 4A. The groove 131 is formed from the end surface of the main part 105 facing the tip end surface 4A to the outer periphery of the main part 105, by notching the corner of the main part 105.

By forming the groove 131 at the outer periphery of the main part 105, the seal member 108 is guided to the groove 131 side to be maintained at the corner 121, when the seal member 108 is held between the locking block 103 and the tip end surface 4A. Consequently, it is possible to maintain a high contact pressure of the seal member 108 to the inner peripheral surface 2A and the tip end surface 4A, thereby making the sealing with the seal member 108 more secure.

Figure 14A:
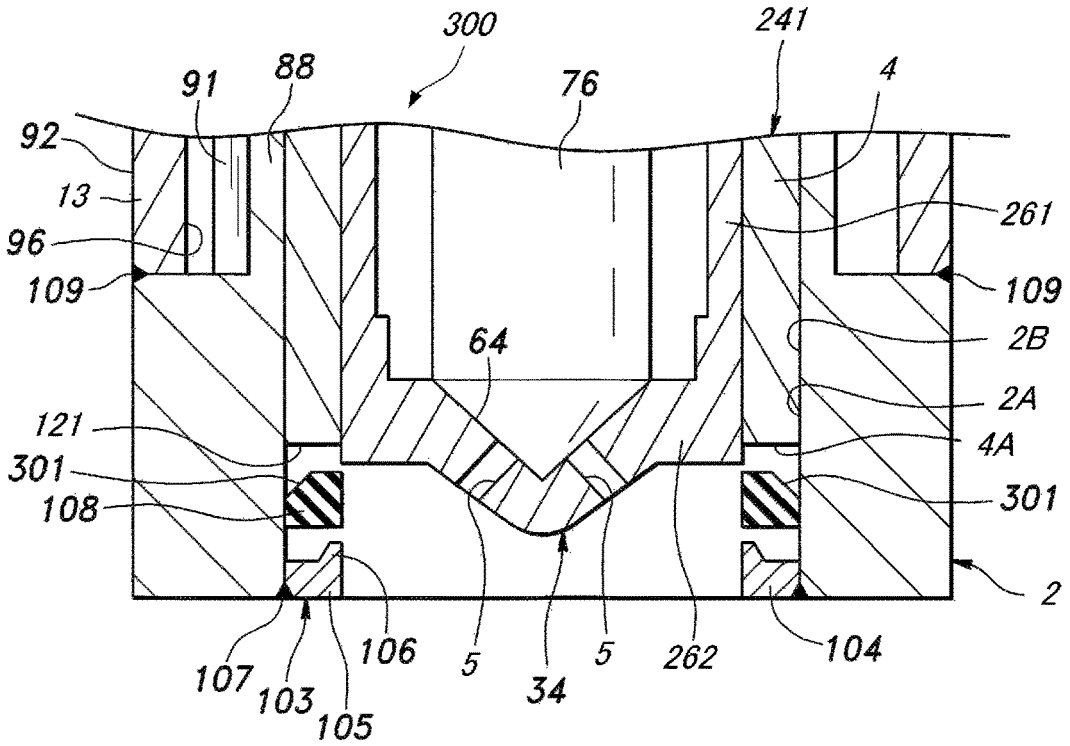
FIGS. 14(A) and 14(B) show a sectional view indicative of a state immediately before the final state where the pressure detecting element is mounted on the small diameter portion of the first body in a second modification, and a sectional view indicative of a state immediately before the final state where the pressure detecting element is mounted on the small diameter portion of the first body in a structure which is obtained by further modifying the second modification.

As shown in FIG. 14(A), in the fuel injection device 300 according to the second modification, a notch 301 is formed at the outer periphery of a portion of the seal member 108 facing the tip end surface 4A. By forming the notch 301, the width of the seal member 108 becomes narrower in the direction of the axis C.

By forming the notch 301 at the outer periphery of the seal member 108, the compression pressure applied to the seal member 108 becomes smaller at the outer periphery compared with that at the inner periphery when the seal member 108 is held between the locking block 103 and the tip end surface 4A. Accordingly, the seal member 108 projects to the outer periphery side to be maintained at the corner 121. Consequently, it is possible to maintain a high contact pressure of the seal member 108 to the inner peripheral surface 2A and the tip end surface 4A, thereby making the sealing with the seal member 108 more secure.

Figure 14B:
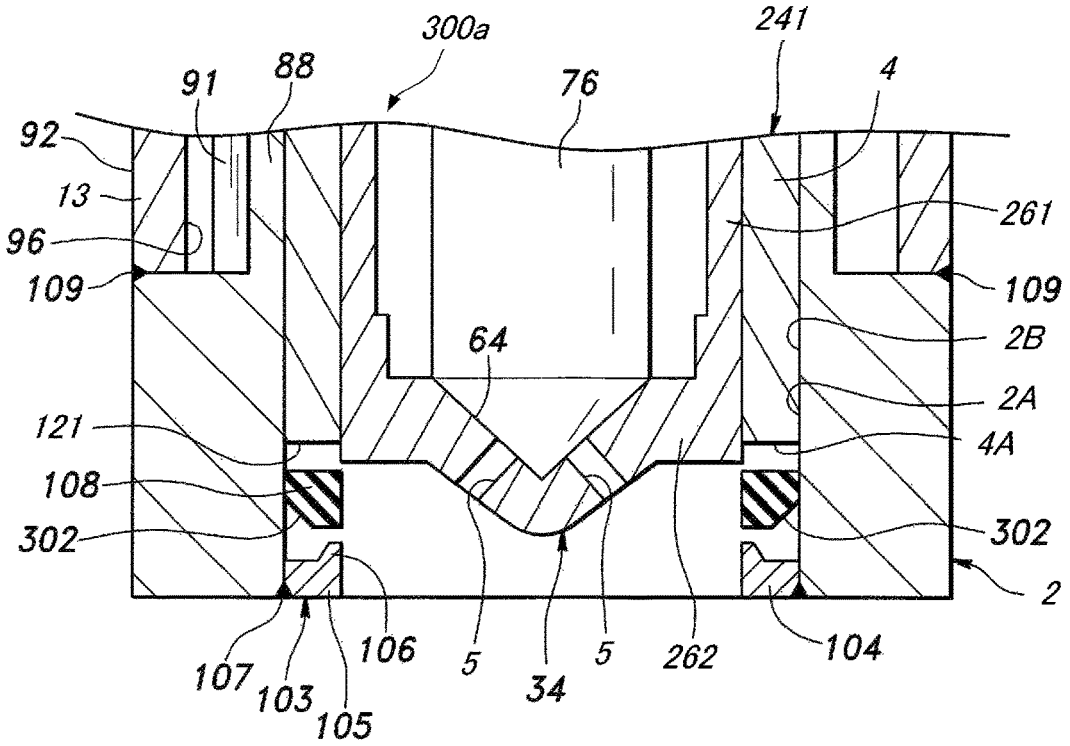

It is to be noted that the second modification may further be modified as shown in FIG. 14(B). In the fuel injection device 300*a* of FIG. 14(B), a notch 302 is formed at the outer periphery of the portion of the seal member 108 facing the main part 105.

Figure 15:
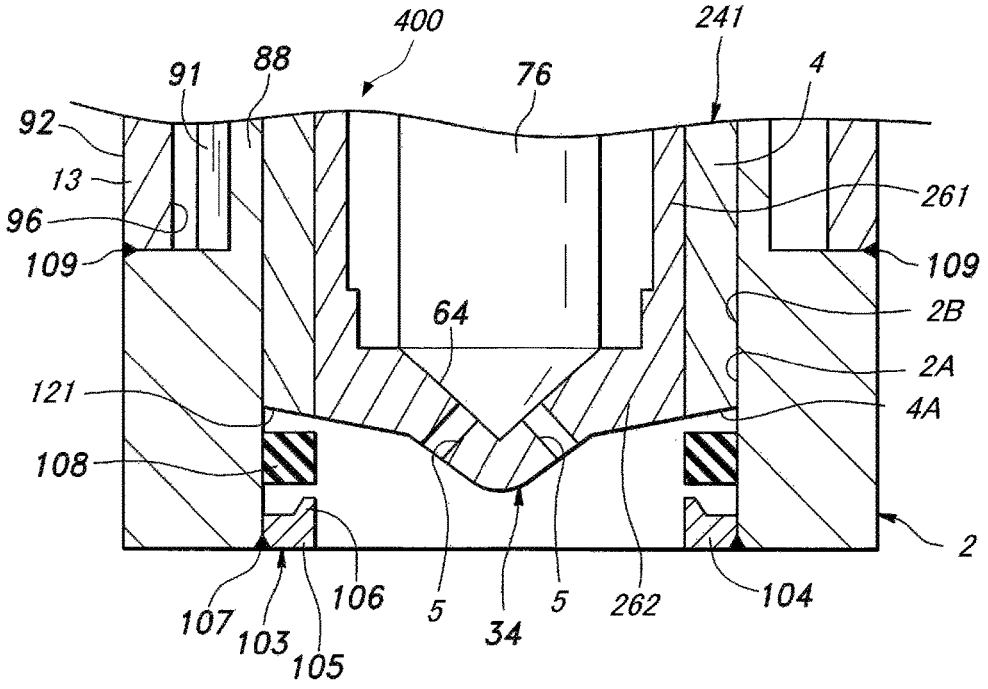
FIG. 15 shows a sectional view indicative of a state immediately before the final state where the pressure detecting element is mounted on the small diameter portion of the first body in a third modification.
Figure 16:
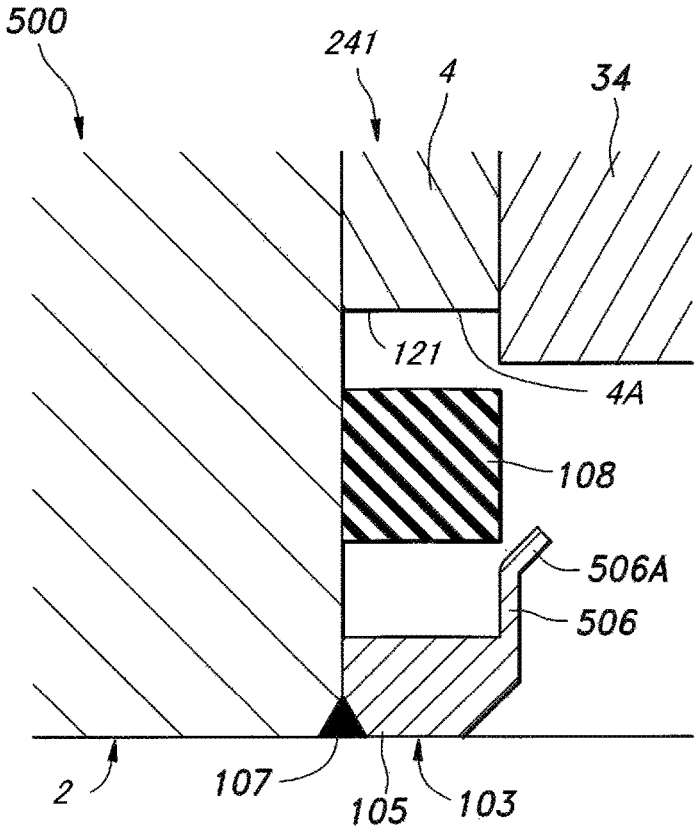
FIGS. 16(A) and 16(B) show a sectional view indicative of a state immediately before the final state where the pressure detecting element is mounted on the small diameter portion of the first body in a fourth modification, and a sectional view indicative of the final state where the pressure detecting element is mounted on the small diameter portion of the first body in the fourth modification.
Figure 16:
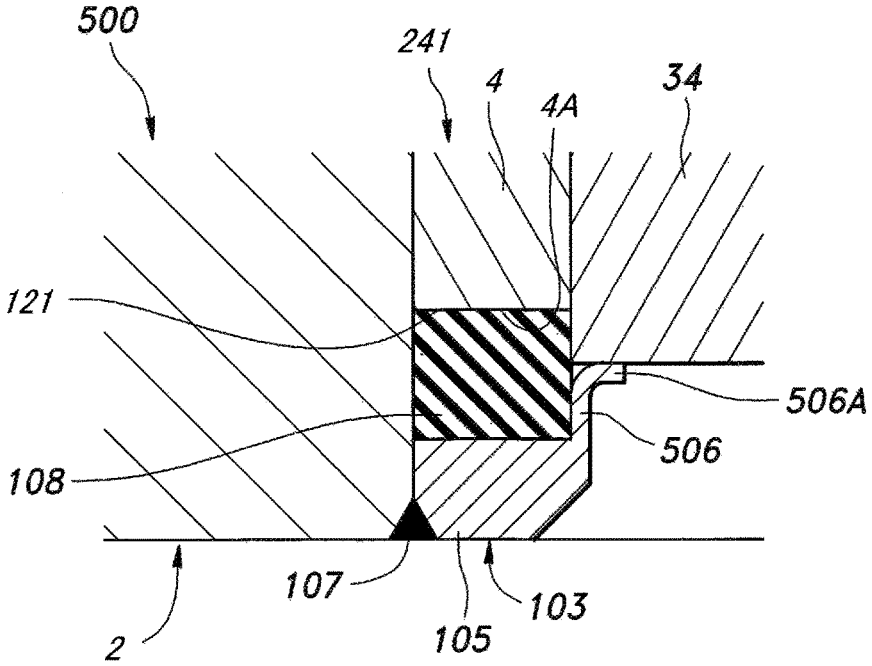

FIG. 15 shows the fuel injection device 400 according to the third modification. In the fuel injection device 400, the tip end surface 4A of the small diameter portion 4 is formed as an inclined surface so that the tip end surface 4A gradually approaches the tip end in the radially-inward direction. With this configuration, the inclined tip end surface 4A restricts the seal member 108 held between the locking block 103 and the tip end surface 4A, thereby making it possible to suppress radially-inward projection of the seal member 108.

FIG. 16(A) shows a fuel injection device 500 according to the fourth modification. In the fuel injection device 500, the wall part 506 of the locking block 103 is thinly formed and has flexibility. The wall part 506 projects toward the tip end surface 4A from the inner periphery of the annularly-formed main part 105, and the wall part 506 is parallel with the axis of the main part 105. The wall part 506 is annularly formed to extend in the circumferential direction. A tip portion 506A of the wall part 506 is bent in the radially inner direction (direction toward the axis C) to extend in the direction toward the tip end surface 4A of the small diameter portion 4A in the state immediately before the pressure detecting element 2 is mounted on the small diameter portion 4 of the first body 241.

As shown in FIG. 16(B), in the state where the pressure detecting element 2 is mounted on the small diameter portion 4 of the first body 241, the wall part 506 is arranged so as to cover the inner periphery of the seal member 95, and the tip portion 506A is elastically deformed to abut on the tip end surface of the nozzle member 34. The recovering force of the wall part 506 acts on the tip portion 506A so that the tip portion 506A is pushed toward the nozzle member 34, and the tip portion 506A tightly contacts the nozzle member 34. The contacting portion between the tip portion 506A of the wall part 506 and the nozzle member 34 is annularly formed to extend in the circumferential direction. Accordingly, the seal member 95 is covered with the base part 105 of the locking block 103 and the wall part 506 and separated from the combustion chamber. Consequently, the seal member is prevented from being exposed to the high temperature gases in the combustion chamber 207, thereby suppressing deterioration of the seal member 108.

In the fourth modification, the tip portion 506A of the wall part 506 abuts on the tip end surface of the nozzle member 34. Alternatively, the width of the seal member 108 in the radial direction may be made to be smaller so that the tip portion 506A of the wall part 506 may abut on the tip end surface 4A of the small diameter portion 4. It is sufficient that the wall part 506 can abut on the member constituting the tip portion of the valve body 233 and cover the seal member 108.

Modifications other than the above-described modifications may be made. For example, the wall part 106 of the locking block 103 may be omitted. Further, a notch may be formed at the inner periphery of the end surface of the main part 105 on the side opposite to the tip end surface 4. By forming the notch, it is avoided that the locking block 103 interferes with the fuel injected from the fuel injection port 5, which makes it possible to set the fuel injection angle wider.

DESCRIPTION OF REFERENCE NUMERALS

1 Fuel injection device
2 Pressure detecting element

10 Synthetic resin mold
11 Amplifying circuit unit
11*a* Synthetic resin mold
21-23 Connector pin
31-33 Connector pin
46 Sensitivity adjusting circuit
47 Failure detection circuit
49 Power source noise filter
51 Connector block
60 Electric control unit
100 In-cylinder pressure detecting unit integrated fuel injection device
101 In-cylinder pressure detecting unit
103 Locking block
108 Seal member
121 Corner
203 Cylinder head
233 Valve body

The invention claimed is:

1. An in-cylinder pressure detecting apparatus for detecting a pressure in a combustion chamber of an internal combustion engine, said in-cylinder pressure detecting apparatus comprising a pressure detecting element mounted on a tip-portion of a fuel injection device which injects fuel into said combustion chamber; and an amplifying circuit unit having an amplifying circuit which amplifies a signal output from said pressure detecting element and outputs a pressure detection signal, said in-cylinder pressure detecting apparatus being characterized in that an in-cylinder pressure detecting unit integrated fuel injection device is configured by integrating an in-cylinder pressure detecting unit with said fuel injection device, said in-cylinder pressure detecting unit including said pressure detecting element, said amplifying circuit unit, and a connecting member connecting said pressure detecting element with said amplifying circuit unit, wherein said in-cylinder pressure detecting unit integrated fuel injection device is mounted on said internal combustion engine, and wherein said amplifying circuit unit has connecting terminals for connecting wires provided between said amplifying circuit unit and a control unit for controlling said fuel injection device, and one of said connecting wires supplies a power source voltage for said amplifying circuit, wherein said fuel injection device is provided with a main-body connector block having connecting terminals to which actuation signal wires are connected, said actuation signal wires supplying an actuation signal from said control unit to said fuel injection device, wherein said in-cylinder pressure detecting unit is provided with a sub-connector block having connecting terminals to which said connecting wire supplying the power source voltage and a detection signal wire are respectively connected, said detection signal wire supplying the pressure detection signal to said control unit, and said sub-connector block is configured separately from said main-body connector block.

2. The in-cylinder pressure detecting apparatus according to claim 1, wherein said in-cylinder pressure detecting unit is configured by previously assembling a sensor fixing member having a cylindrical shape, said amplifying circuit unit, and said connecting member connecting said pressure detecting element with said amplifying circuit unit, said pressure detecting element being fixed on a tip-portion of said sensor fixing member, wherein said sensor fixing member is fitted onto the tip-portion of said fuel injection device.

3. The in-cylinder pressure detecting apparatus according to claim 2, wherein said amplifying circuit unit is fixed on an outside of a metal casing which contains an actuation circuit of said fuel injection device, in a state where said amplifying circuit unit is covered by molding material, or in a state where said amplifying circuit unit is contained in a metal casing.

4. The in-cylinder pressure detecting apparatus according to claim 2, wherein said amplifying circuit unit includes a failure detection circuit for a control unit to diagnose a connecting condition between said amplifying circuit unit and said control unit to which the pressure detection signal is supplied.

5. The in-cylinder pressure detecting apparatus according to claim 2, wherein said amplifying circuit unit includes a sensitivity adjusting circuit for performing a gain adjustment of said amplifying circuit.

6. The in-cylinder pressure detecting apparatus according to claim 2, wherein said amplifying circuit unit includes a noise filter for eliminating noises entering a power source line for supplying the power source, and/or noises superimposed on the pressure detection signal.

7. The in-cylinder pressure detecting apparatus according to claim 2, wherein said amplifying circuit unit is configured on a flexible printed wiring board.

8. The in-cylinder pressure detecting apparatus according to claim 2, wherein said in-cylinder pressure detecting unit integrated fuel injection device includes:

a valve body having said tip-portion inserted into an injector hole which is formed in a main-body of said internal combustion engine, said tip-portion facing said combustion chamber; and a seal member having an annular shape and sealing a gap between an outer surface of said valve body and an inner surface of said pressure detecting element, wherein said pressure detecting element is configured in a cylindrical shape, and the tip-portion of said valve body is inserted inside said pressure detecting element, said pressure detecting element being supported on the outer periphery of said valve body, wherein a tip end portion of said pressure detecting element positioned on the combustion chamber side extends further from the tip end of said valve body toward the combustion chamber, and the tip end portion of said pressure detecting element has a locking block on an inner surface thereof, said locking block projecting toward the axis of said valve body, wherein said seal member is disposed at a corner defined by the inner surface of said pressure detecting element and the tip end surface of said valve body, said seal member being sandwiched between said locking block and said valve body.

9. The in-cylinder pressure detecting apparatus according to claim 1, wherein said amplifying circuit unit is fixed on an outside of a metal casing which contains an actuation circuit of said fuel injection device, in a state where said amplifying circuit unit is covered by molding material, or in a state where said amplifying circuit unit is contained in a metal casing.

10. The in-cylinder pressure detecting apparatus according to claim 1, wherein said amplifying circuit unit includes a failure detection circuit for a control unit to diagnose a connecting condition between said amplifying circuit unit and said control unit to which the pressure detection signal is supplied.

11. The in-cylinder pressure detecting apparatus according to claim 1, wherein said amplifying circuit unit includes a sensitivity adjusting circuit for performing a gain adjustment of said amplifying circuit.

12. The in-cylinder pressure detecting apparatus according to claim 1, wherein said amplifying circuit unit includes a noise filter for eliminating noises entering a power source line for supplying the power source, and/or noises superimposed on the pressure detection signal.

13. The in-cylinder pressure detecting apparatus according to claim 1, wherein said amplifying circuit unit is configured on a flexible printed wiring board.

14. The in-cylinder pressure detecting apparatus according to claim 1, wherein said in-cylinder pressure detecting unit integrated fuel injection device includes:

a valve body having said tip-portion inserted into an injector hole which is formed in a main-body of said internal combustion engine, said tip-portion facing said combustion chamber; and a seal member having an annular shape and sealing a gap between an outer surface of said valve body and an inner surface of said pressure detecting element, wherein said pressure detecting element is configured in a cylindrical shape, and the tip-portion of said valve body is inserted inside said pressure detecting element, said pressure detecting element being supported on the outer periphery of said valve body, wherein a tip end portion of said pressure detecting element positioned on the combustion chamber side extends further from the tip end of said valve body toward the combustion chamber, and the tip end portion of said pressure detecting element has a locking block on an inner surface thereof, said locking block projecting toward the axis of said valve body, wherein said seal member is disposed at a corner defined by the inner surface of said pressure detecting element and the tip end surface of said valve body, said seal member being sandwiched between said locking block and said valve body.

15. An in-cylinder pressure detecting apparatus for detecting a pressure in a combustion chamber of an internal combustion engine, said in-cylinder pressure detecting apparatus comprising a pressure detecting element mounted on a tip-portion of a fuel injection device which injects fuel into said combustion chamber; and an amplifying circuit unit having an amplifying circuit which amplifies a signal output from said pressure detecting element and outputs a pressure detection signal, said in-cylinder pressure detecting apparatus being characterized in that an in-cylinder pressure detecting unit integrated fuel injection device is configured by integrating an in-cylinder pressure detecting unit with said fuel injection device, said in-cylinder pressure detecting unit including said pressure detecting element, said amplifying circuit unit, and a connecting member connecting said pressure detecting element with said amplifying circuit unit, wherein said in-cylinder pressure detecting unit integrated fuel injection device is mounted on said internal combustion engine, wherein said amplifying circuit unit has connecting terminals for connecting wires provided between said amplifying circuit unit and a control unit for controlling said fuel injection device, and one of said connecting wires supplies a power source voltage for said amplifying circuit, wherein said in-cylinder pressure detecting unit integrated fuel injection device includes:

a valve body having said tip-portion inserted into an injector hole which is formed in a main-body of said internal combustion engine, said tip-portion facing said combustion chamber; and a seal member having an annular shape and sealing a gap between an outer surface of said valve body and an inner surface of said pressure detecting element, wherein said pressure detecting element is configured in a cylindrical shape, and the tip-portion of said valve body is inserted inside said pressure detecting element, said pressure detecting element being supported on the outer periphery of said valve body, wherein a tip end portion of said pressure detecting element positioned on the combustion chamber side extends further from the tip end of said valve body toward the combustion chamber, and the tip end portion of said pressure detecting element has a locking block on an inner surface thereof, said locking block projecting toward the axis of said valve body, wherein said seal member is disposed at a corner defined by the inner surface of said pressure detecting element and the tip end surface of said valve body, said seal member being sandwiched between said locking block and said valve body.

* * * * *